US007843137B2

(12) United States Patent
Watanabe et al.

(10) Patent No.: US 7,843,137 B2
(45) Date of Patent: Nov. 30, 2010

(54) LUMINOUS VESSELS

(75) Inventors: Keiichiro Watanabe, Kasugai (JP); Takashi Ota, Kasugai (JP); Norikazu Niimi, Kasugai (JP)

(73) Assignee: NGK Insulators, Ltd., Nagoya (JP)

( * ) Notice: Subject to any disclaimer, the term of this patent is extended or adjusted under 35 U.S.C. 154(b) by 497 days.

(21) Appl. No.: 11/392,106

(22) Filed: Mar. 29, 2006

(65) Prior Publication Data

US 2006/0220558 A1 Oct. 5, 2006

(30) Foreign Application Priority Data

Mar. 31, 2005 (JP) ..... 2005-101983

(51) Int. Cl.
*H01J 17/18* (2006.01)

(52) U.S. Cl. ..... 313/625

(58) Field of Classification Search ..... 313/627–643, 313/567, 111–117, 25–27, 318.01–318.09; 439/615, 739; 445/24, 26, 29, 22
See application file for complete search history.

(56) References Cited

U.S. PATENT DOCUMENTS 3,531,853 A * 10/1970 Klomp ..... 228/193
4,155,758 A * 5/1979 Evans et al. ..... 75/232
4,160,930 A * 7/1979 Driessen et al. ..... 313/283
5,404,078 A 4/1995 Bunk et al.
5,557,169 A 9/1996 Van Lierop et al.
5,742,123 A 4/1998 Nagayama
5,861,714 A 1/1999 Wei et al.
6,194,832 B1 * 2/2001 Juengst ..... 313/625
6,218,025 B1 * 4/2001 Fromm et al. ..... 428/544
6,232,718 B1 * 5/2001 Johnston et al. ..... 313/623
6,362,567 B1 3/2002 Niimi
6,495,959 B1 * 12/2002 Ikeuchi et al. ..... 313/623
6,979,958 B2 * 12/2005 Zhu et al. ..... 315/246
7,329,979 B2 * 2/2008 Bewlay et al. ..... 313/318.01
2001/0020820 A1 * 9/2001 Kaneko et al. ..... 313/623
2002/0008476 A1 * 1/2002 Fidler et al. ..... 313/623
2002/0135304 A1 * 9/2002 Honda et al. ..... 313/634
2002/0153837 A1 * 10/2002 Johnston et al. ..... 313/567
2003/0080684 A1 * 5/2003 Okuyama ..... 313/625
2005/0073256 A1 * 4/2005 Jackson et al. ..... 313/634
2005/0248279 A1 * 11/2005 Lambrechts et al. ..... 313/640
2006/0001346 A1 * 1/2006 Vartuli et al. ..... 313/318.01

(Continued)

FOREIGN PATENT DOCUMENTS

CN 1071029 A1 4/1993

(Continued)

OTHER PUBLICATIONS

U.S. Appl. No. 11/392,036, filed Mar. 29, 2006, Watanabe et al.

*Primary Examiner*—Nimeshkumar D Patel
*Assistant Examiner*—Donald L Raleigh
(74) *Attorney, Agent, or Firm*—Burr & Brown

(57) ABSTRACT

The inventive luminous vessel has strong bonding and improved adhesion of the current through conductor provided in the luminous container to a sealing member or the like. A luminous vessel has a luminous container, a solid current through conductor made of a metal or a cermet and a sintered body of a molded body containing at least metal powder fixed to the outside of the current through conductor.

19 Claims, 18 Drawing Sheets

U.S. PATENT DOCUMENTS

2006/0138962 A1 * 6/2006 Wei et al. ..... 313/634

FOREIGN PATENT DOCUMENTS

| | | | | |
|---|---|---|---|---|
| CN | 1204857 | A1 | | 1/1999 |
| CN | 1211341 | A1 | | 3/1999 |
| DE | 19618967 | A1 | * | 11/1996 |
| EP | 0 528 428 | | | 2/1993 |
| EP | 650184 | A1 | * | 4/1995 |
| EP | 0 887 837 | | | 12/1998 |
| JP | 05-198285 | | | 8/1993 |
| JP | 5-198285 | | | 8/1993 |
| JP | 05-334989 | | | 12/1993 |
| JP | 07-192697 | A1 | | 7/1995 |
| JP | 9-265943 | | | 10/1997 |
| JP | 11-073920 | | | 3/1999 |
| JP | 11-149903 | A1 | | 6/1999 |
| JP | 2001-035445 | | | 2/2001 |
| JP | 2002-260580 | | | 9/2002 |

* cited by examiner

LUMINOUS VESSELS

This application claims the benefit of Japanese Patent Application P2005-101983 filed on Mar. 31, 2005, the entirety of which is incorporated by reference.

TECHNICAL FIELD

The present invention relates to a luminous vessel.

BACKGROUND OF THE INVENTION

According to a high pressure discharge lamp disclosed in Japanese patent publication 11-149903A, a tungsten electrode is fitted to the tip end of a pipe-shaped current through conductor of molybdenum and inserted into a luminous container of a high pressure discharge lamp. Then, a ring-shaped sealing member made of molybdenum cermet is fitted onto the outer periphery of the pipe-shaped current through conductor and sintered so that the current through conductor and sealing member are attached to the tip end of the luminous container.

According to a high pressure discharge lamp of ceramic metal halide type disclosed in Japanese patent publication 7-192697A, a current supply conductor has a first part having a relatively high melting point and a second part having a relatively low melting point. The parts are opposed at the end faces and welded to produce a connection. Further, an electrode is welded to the tip end of the first part having a higher melting point.

DISCLOSURE OF THE INVENTION

According to the structure disclosed in Japanese patent publication 11-149903A, however, the bonding of the pipe-shaped current through conductor of molybdenum and the tungsten electrode is difficult, according to the following reasons. Both of molybdenum and tungsten are high melting point metals and difficult to melt, have high hardness and are brittle, so that a process for bonding them at a high bonding strength is difficult and requires a high cost.

It is preferred to form a pipe-shaped current through conductor by molybdenum for reducing the difference of thermal expansion coefficients of and improving air-tightness between a cermet sealing material and the current through conductor. Although it may be speculated that the pipe-shaped current through conductor is made of tungsten as an electrode, the difference of thermal expansion coefficients of the cermet sealing material and current through conductor becomes large, and the air-tightness between them tends to be deteriorated.

Similarly, according to the structure disclosed in Japanese patent publication 7-192697A, for example, the combination of the first part made of tungsten and the second part of tantalum, and the combination of the first part of molybdenum and the second part of niobium are described. These materials are high melting point metals and hard to melt, have high hardness and are brittle, so that a process for bonding them at a high bonding strength is difficult and requires a high cost.

According to the structure disclosed in Japanese patent publication 7-192697A, a high level bonding technique is required so that the current through conductor is inserted into a ceramic lead through tube and a sealing frit is molten and flown into the interface of the first and second parts to carry out the sealing and fixing while avoiding an excess thermal stress. Such process requires accurate control of process parameters, so that the yield tends to be lowered and the processing cost tends to be higher.

An object of the present invention is to provide a luminous vessel whose bonding with a current through conductor provided inside of the vessel is strong and the adhesion is improved.

The present invention provides a luminous vessel comprising a luminous container comprising a brittle material, a solid current through conductor comprising a metal or a cermet and a sintered body of a molded body comprising at least metal powder, wherein the sintered body is fixed outside of the current through conductor.

The present invention will be described below in detail, referring to the attached drawings. According to the present invention, for example as shown in FIGS. 1(*a*) and 1(*b*), for example disk-shaped molded body 1 of metal powder (or mixture of metal powder and ceramic powder) is prepared. A through hole 1*a* is formed in the molded body 1. As shown in FIG. 1(*c*), a solid current through conductor 2 made of a metal or a cermet is then inserted into the through hole 1*a*. The molded body 1 is thus sintered to obtain a composite body 3 shown in FIG. 1(*d*). The composite body 3 has a solid current through conductor 2 made of a metal and a disk-shaped sintered body 11 fitted to the outer periphery of the current through conductor 2. The conductor 2 is inserted into the through hole 11*a*. During the sintering process, the molded body 1 is shrunk due to the sintering. Adhesion force is thus generated between the outer surface of the conductor 2 and the inner surface of the through hole 1*a* of the molded body due to the action of sintering shrinkage, and compressive force is generated to the outer surface of the current through conductor radially due the sintering shrinkage of the molded body 1. The sintered body 11 is thus strongly fixed around the conductor 2.

According to such composite body, the bonding of the current through conductor 2 with the sintered body 11 is strong and air-tight, and resistive against thermal cycles because sintering process is applied to the bonding. If the conductor 2 would have been tubular, the sintering shrinkage of the molded body 1 would result in the shrinkage and deformation of the conductor 2 radially, so that the stress due to the sintering shrinkage of the molded body 1 is escaped radially. A strong and air-tight bonding cannot be obtained.

Particularly, according to the present invention, even when the whole of the current through conductor is made of a material suitable as the electrode material such as tungsten, the conductor can be bonded to a luminous vessel strongly and in air tight manner. The whole of the conductor may be formed of one kind of appropriate material such as tungsten to alleviate the need of bonding process of high melting point metals and thereby to considerably reduce the production cost.

Similarly, according to the present invention, for example as shown in FIGS. 2(*a*) and 2(*b*), for example disk-shaped molded body 1 of metal powder (or mixture of metal powder and ceramic powder) is prepared. A through hole 1*a* is formed in the molded body 1. As shown in FIG. 2(*c*), solid elongate products 2*a* and 2*b* made of a metal or a cermet are then inserted into the through hole 1*a*, so that the elongate products 2*a* and 2*b* contact with each other at a contact part located at the center of the molded body 1. The molded body 1 is thus sintered to obtain a composite body 3 shown in FIG. 1(*d*). The composite body 3 has a solid elongate products 2*a* and 2*b* made of a metal and a disk-shaped sintered body 11 fitted to the outer periphery of the elongate products 2*a* and 2*b*. The elongate products 2*a* and 2*b* are inserted into the through hole 1*a*. During the sintering process, the molded body 1 is shrunk due to the sintering. Adhesion force is thus generated between the outer surfaces of the elongate products 2*a* and 2*b* and the inner surface of the through hole 1*a* of the molded body due to the action of sintering shrinkage, and compressive force is generated to the outer surfaces of the elongate products 2*a* and 2*b* radially due the sintering shrinkage of the molded body 1. The sintered body 11 is thus strongly fixed around the elongate products 2*a* and 2*b*.

According to such composite body, the bonding of the current through conductor 2 or elongate products 2*a* and 2*b* with the sintered body 11 is strong, air-tight, and resistive against thermal cycles because sintering process has been applied to the bonding. If the conductor 2 or elongate products 2*a* and 2*b* would have been tubular, the sintering shrinkage of the molded body 1 results in the shrinkage and deformation of the conductor 2 or elongate products 2*a* and 2*b* radially, so that the stress due to the sintering shrinkage of the molded body 1 is escaped radially. A strong and air-tight bonding cannot be thus obtained.

BRIEF DESCRIPTION OF THE DRAWINGS

FIG. 1(*b*) is a front view of the molded body 1,

FIG. 1(*c*) is a cross sectional view showing an current through conductor 2 inserted into the molded body 1.

FIG. 1(*d*) is a cross sectional view showing a composite body 3 obtained by sintering an assembly of FIG. 1(*c*).

FIG. 2(*b*) is a front view showing the molded body 1.

FIG. 2(*c*) is a cross sectional view showing elongate products 2*a* and 2*b* inserted into the molded body 1.

FIG. 2(*d*) is a cross sectional view showing a composite body 3 obtained by sintering an assembly of FIG. 2(*c*).

FIG. 3(*b*) is a cross sectional view showing a current through conductor 2 inserted into the molded body 1A.

FIG. 3(*c*) is a cross sectional view showing a composite body 3A obtained by sintering an assembly of FIG. 3(*b*).

FIG. 3(*d*) is a cross sectional view showing another composite 3B.

FIG. 4(*d*) is a cross sectional view showing the molded body 1C fitted to the current through conductor 2.

FIG. 4(*e*) is a cross sectional view showing a composite body 3C obtained by the sintering of the molded body 1C.

FIG. 6(*d*) is a cross sectional view showing a composite body,

FIG. 17(*c*) is a cross sectional view showing an end part of a luminous vessel for a high pressure discharge lamp.

FIG. 18(*b*) is a cross sectional view showing the molded bodies 1 and 16 fitted to a current through conductor 2.

FIG. 18(*c*) is a cross sectional view showing composite bodies obtained by sintering the molded bodies of FIG. 18(*b*).

FIG. 18(*d*) is a cross sectional view showing the structure of end portion of a luminous vessel for a high pressure discharge lamp obtained by using the composite body of FIG. 18(*c*).

BEST MODES FOR CARRYING OUT THE INVENTION

Figure 1:
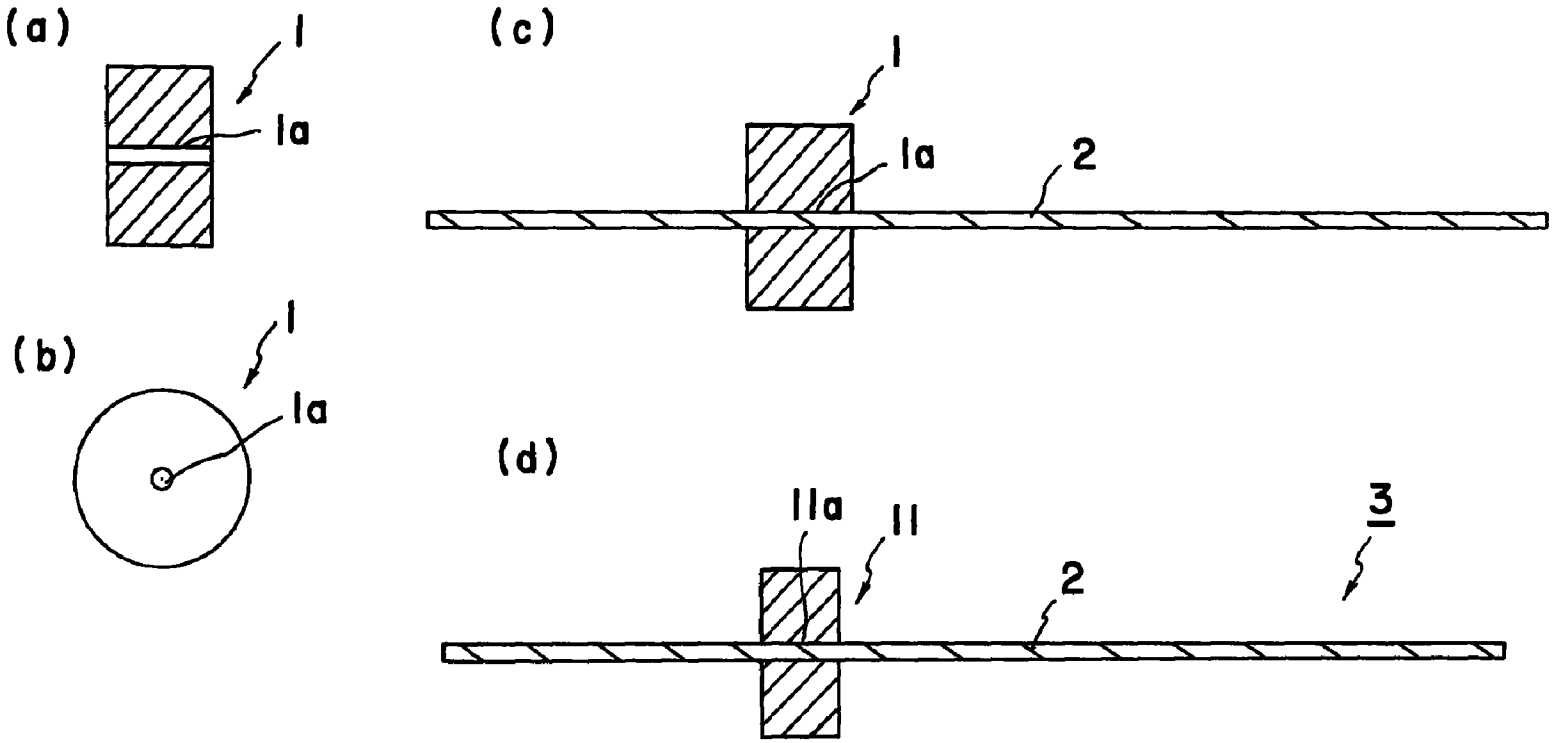
FIG. 1(*a*) is a cross sectional view showing a molded body 1.

According to a preferred embodiment, a sintered body has a shape of a disk (refer to FIGS. 1 and 2) or a tube. According to an example shown in FIG. 3, a tube-shaped sintered body is produced. As shown in FIGS. 3(*a*) and 3(*b*), a tube-shaped molded body 1A of metal powder (or a mixture of metal powder and ceramic powder) is prepared. A through hole 1*a* is formed in the molded body 1A. As shown in FIG. 3(*b*), a solid current through conductor 2 is then inserted into the through hole 1*a*. The molded body 1A of a metal or a cremet is then sintered to obtain a composite body 3A shown in FIG. 3(*c*). The composite body 3A has a solid current through conductor 2 made of a metal and a tube-shaped sintered body 11A fitted to the outer periphery of the conductor 2. The conductor 2 is inserted into the through hole 11*a*. During the sintering step, adhesion force is generated between the outer surface of the conductor 2 and the inner surface of the through hole 1*a* of the molded body due to the action of sintering shrinkage, and compressive force is generated to the outer surface of the conductor 2 radially due the sintering shrinkage of the molded body 1A. The sintered body 11A is thus strongly fixed around the conductor 2.

According to an example of FIG. 3(*d*), a disk-shaped sintered body 11*a* and a tube-shaped sintered body 1*a* are fixed to the outer periphery of the current through conductor 2, according to the present invention.

Although the shape of the current through conductor is not particularly limited, the shape may be a rod or a plate. The cross sectional shape of the current through conductor is not particularly limited, and may be optional shape such as a true circle, ellipsoid, race track pattern, or a polygonal shape such tetragonal or triangle.

The outer diameter of the current through conductor is not particularly limited. If the outer diameter of the current through conductor is too large, however, the amount of the shrinkage of the molded body during sintering becomes large and the tensile stress generated in the sintered body becomes too large, so that cracks may be generated in the sintered body and the adhesion with the conductor is deteriorated. On the viewpoint of the present invention, the outer diameter of the conductor may preferably be 5.0 mm or smaller and more preferably be 3.0 mm or smaller. If the outer diameter of the conductor is too small, however, the amount of shrinkage during the sintering becomes small, so that the clamping and compressive forces become small and the fixing of the conductor tends to be difficult. The outer diameter of the conductor may preferably be 0.1 mm or larger.

The material of the current through conductor is not particularly limited, and may be any metals or cermets. The present invention is most advantageous, however, in that a composite body having a strong bonding can be produced even when the current through conductor is made of a high melting point metal or a cermet containing such metal difficult to process. On the viewpoint, the material may preferably be a metal having a melting point of 1500° C. or higher or a cermet containing such metal.

Such metal forming the current through conductor may preferably be one or more metal(s) selecting from the group consisting of molybdenum, tungsten, tantalum and iridium and the alloys thereof. Further the cermet may preferably be a sintered body of the above high melting point metal and ceramic powder. Such ceramic powder including the followings.

That is, ceramic powder having a high melting point such as alumina, zirconia, silicon nitride, silicon carbide, mullite, spinel, YAG (3Y2O3.5Al2O3) etc.

Further on the viewpoint of maintaining the conductivity of the current through conductor at a high value, the ratio of the metal of the cermet may preferably be 30 volume percent or higher and more preferably be 50 volume percent or higher.

Further, the shape of the sintered body is not particularly limited, as far as a compressive force can be applied toward the current through conductor radially due to the sintering shrinkage. A through hole for inserting the conductor may preferably be formed in the sintered body. According to a preferred embodiment, the shape of the sintered body is tube or a disk.

The material of the sintered body is not particularly limited, and may be any metals or cermets. The present invention is most advantageous, however, in that a composite body having a strong bonding can be produced even when the sintered body is made of a high melting point metal or a cermet containing such metal difficult to process. On the viewpoint, the material may preferably be a metal having a melting point of 1500° C. or higher or a cermet containing such metal.

Such metal forming the sintered body may preferably be one or more metal(s) selecting from the group consisting of molybdenum, tungsten, tantalum and niobium and the alloys thereof. Further the cermet may preferably be a sintered body of the above high melting point metal and ceramic powder. Such ceramic powder including the followings.

That is, ceramic powder having a high melting point such as alumina, zirconia, silicon nitride, silicon carbide, mullite, spinel, YAG (3Y2O3.5Al2O3) etc.

On the viewpoint of reducing the thermal stress generated in a fitting part of a luminous vessel by lowering the difference of thermal expansions of the sintered body and fitting part, the volume ratio of the metal of the cermet may preferably in a range where the difference of thermal expansion coefficients of the cermet and the fitting part is 2 ppm or smaller, and more preferably 1 ppm or smaller.

More preferably, the sintered body is composed of tungsten, a cermet containing tungsten, molybdenum, a cermet containing molybdenum, niobium and a cermet containing niobium, tantalum and a cermet containing tantalum.

The particle diameter of the metal powder forming the sintered body is not particularly limited, and may be decided considering the amount of sintering shrinkage. The particle diameter of the metal powder may be, for example, 0.5 μm to 50 μm. Further, the particle diameter of the ceramic powder is not particularly limited and is decided considering the amount of shrinkage, and may be 0.1 μm to 10 μm, for example. Further, the method of molding of the molded body before sintering is not particularly limited, and may be any of optional methods such as extrusion, press molding, slip cast molding and doctor blade process.

Further, when the sintered body is molded, a dispersant may be added to the metal powder (and optionally ceramic powder). Such dispersant includes water, ethanol, isopropyl alcohol, butyl carbitol or the like. Further, other dispersants include PVA (polyvinyl alcohol), methyl cellulose, ethyl cellulose and surfactants and plasticizers or the like.

Further, the molded body before the sintering may be a molded body of a predetermined wet material, a dried body obtained by drying the molded body, or a dewaxed body obtained by dewaxing the dried body.

The sintering temperature is not limited because it is decided depending on the kind the material. Generally, the sintering temperature may be 1400 to 2000° C.

According to a preferred embodiment, the whole of the current through conductor is composed of the same material. It is thus possible to reduce the manufacturing costs of the conductor and thus composite body. Further, tungsten, molybdenum or the like may be welded to the end of the conductor.

The applications of the inventive composite body is not particularly limited and include the followings.

Electrodes of various kinds of high pressure discharge lamps, electrodes of luminous vessels of projectors, other composites of metal articles and ceramic articles According to a preferred embodiment, the current through conductor functions as an electrode. In this case, the whole of the electrode can be made of the same material, and it is thus unnecessary to weld different, but appropriate, materials. It is thus unnecessary to weld high melting point metals, so that the production cost can be considerably reduced.

Figure 2:
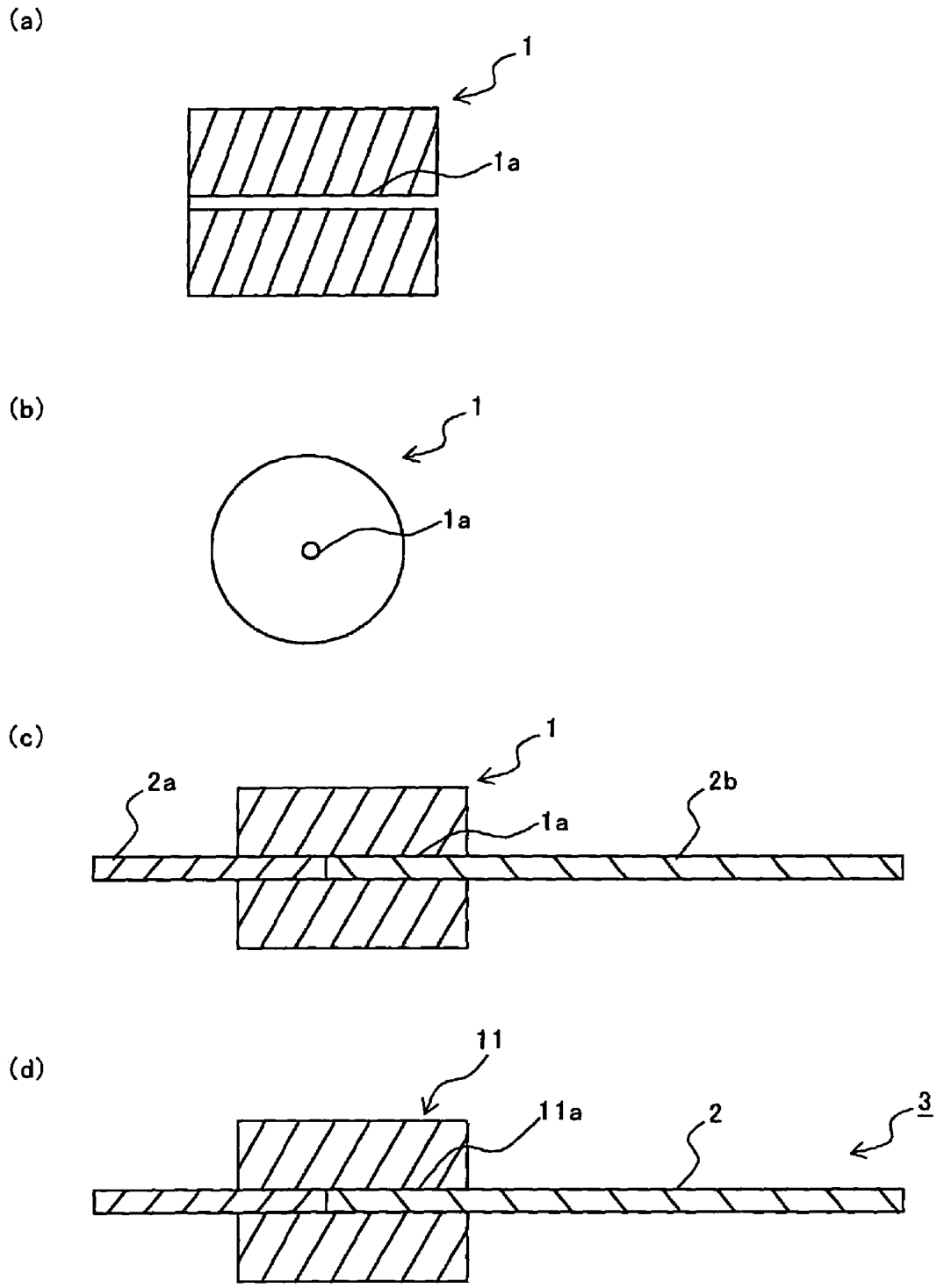
FIG. 2(*a*) is a cross sectional view showing a molded body 1.
Figure 3:
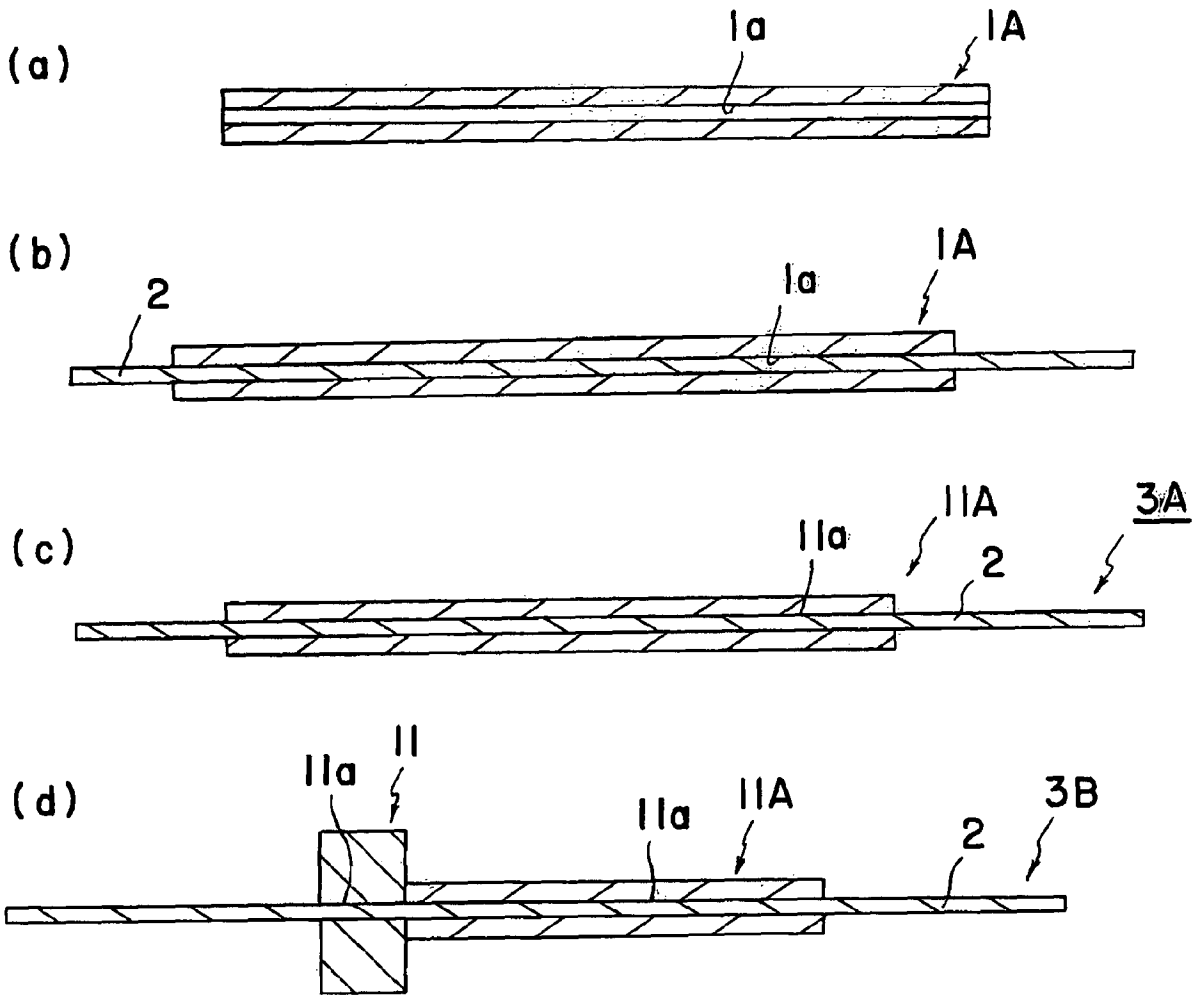
FIG. 3(*a*) is a cross sectional view showing a tube shaped molded body 1A.

Similarly, according to the method, for example as shown in FIG. 2, of joining a plurality of elongate products at the end faces and of fixing a sintered body around the outside of the elongate products at the joined part, it is also unnecessary to weld different, but appropriate, materials. It is thus unnecessary to join high melting point metals by welding, so that the production cost can be considerably reduced.

Further, according to a preferred embodiment, the sintered body functions as a fitting part for a luminous vessel. It is thus possible to fit the current through conductor functioning as an electrode inside of the luminous vessel, so that the present invention is particularly suitable to a high pressure discharge lamp.

Further, according to a preferred embodiment, the sintered body functions as an electrode radiator. The radiation of heat at the end portion of the electrode can be improved so that the invention is particularly suitable to a high pressure discharge lamp.

Further, according to a preferred embodiment, the sintered body functions as a sleeve for adjusting the diameter of the current through conductor. It is thus possible to control the volume of a space defined by the conductor and lead through tube of the luminous vessel to improve the efficiency and use life of the luminous vessel, so that the invention is suitable to a high pressure discharge lamp.

Further, according to a preferred embodiment, the sintered body functions as an end part used for the welding with a current lead wire. When the current through conductor is composed of a material hard to weld such as tungsten, cermet or the like, the welding and bonding with a lead wire for current supply becomes very difficult. The sintered body composed of a material easy to weld such as tungsten, niobium, tantalum etc. is fixed outside of the current through conductor, so that the welding with the lead wire for current supply becomes easy and the invention is particularly suitable for a high pressure discharge lamp.

Further, the relationship of the inner diameter of the sintered body and the outer diameter of the current through conductor is important for obtaining the adhesion of both. It is necessary to adjust the inner diameter of the molded body so that the inner diameter of the sintered body when the conductor would have not been inserted into the molded body is smaller than that of the outer diameter of the conductor by 2 to 20 percent. Further, the outer diameter of the sintered body is not particularly limited. If the outer diameter of the sintered body is too large, the molding and sintering of the sintered body becomes difficult, so that the outer diameter of the sintered body may preferably be 50 mm or smaller. Further, the outer diameter of the sintered body may preferably be larger than the outer diameter of the conductor by 0.1 mm or more and more preferably be larger by 0.3 mm or more.

The thickness of the sintered body is not particularly limited and may be 0.1 mm or more and 20 mm or less, for example. Further, the inner diameter of the molded body is not smaller than the outer diameter of the current through conductor, and the difference may preferably be 0.01 mm or larger on the viewpoint of workability of the assembling of both.

It may be provided a ring-shaped protrusion having a thickness of 0.1 to 1 mm and a height of 5 mm or lower and 1 mm or higher on the outer periphery of the sintered body. Such ring-shaped protrusion may function as a fitting part to another outer member.

The present invention will be further described in detail, referring to the attached drawings.

Figure 4:
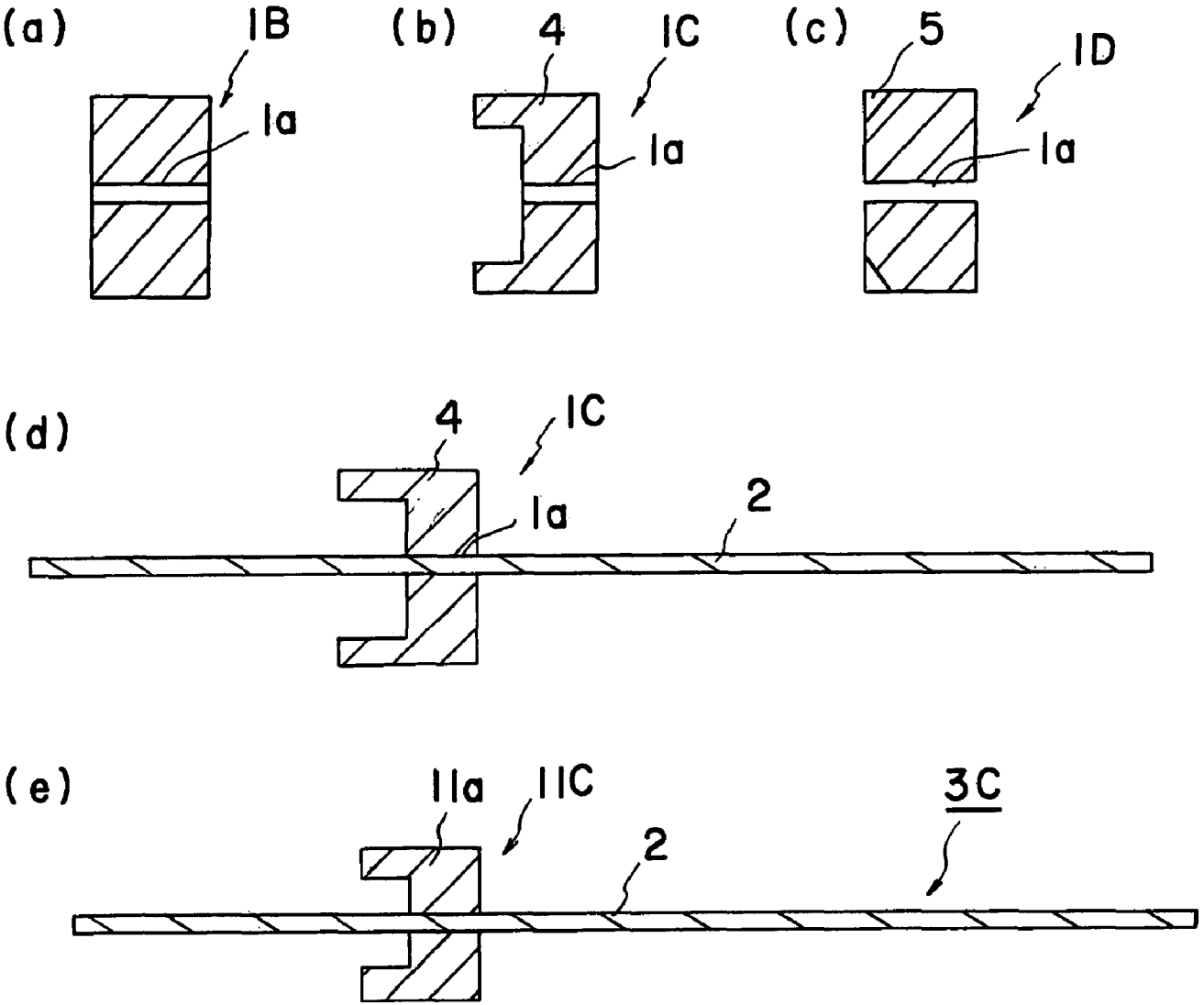
FIG. 4(*a*), FIG. 4(*b*) and FIG. 4(*c*) are cross sectional views showing molded bodies 1B, 1C and 1D, respectively.

FIGS. 4(*a*), 4(*b*) and 4(*c*) are cross sectional views showing molded bodies 1B, 1C and 1D, respectively, applicable in the present invention. A ring-shaped protrusion 4 is formed on the outer edge of a molded body 1C. Further, a chamfered part 5 is formed on the outer edge of a molded body 1D. These molded bodies are fitted to the outer periphery of the current through 2 as shown in FIG. 4(*d*) and then sintered to obtain a sintered body 11C and a composite body 3C shown in FIG. 4(*e*).

Figure 5:
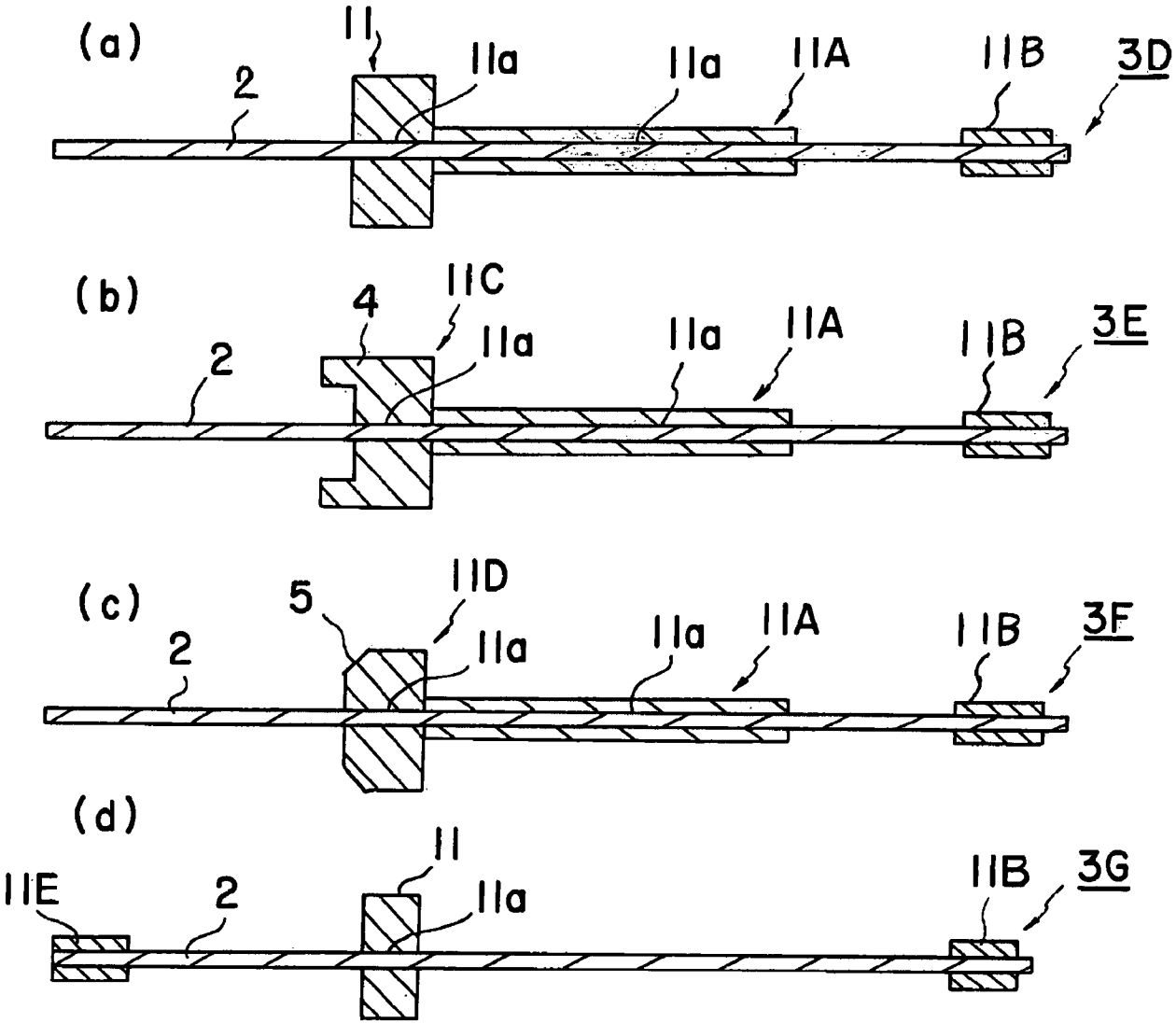
FIG. 5(*a*), FIG. 5(*b*), FIG. 5(*c*) and FIG. 5(*d*) are cross sectional views showing composite bodies 3D, 3E, 3F and 3G, respectively.

FIGS. 5(*a*), (*b*), (*c*) and (*d*) are front views showing composite bodies 3D, 3E, 3F and 3G, respectively, according to the present invention. A disk shaped sintered body 11 and a tube shaped sintered bodies 11A and 11B are fixed to the outer periphery of the current through conductor 2 in the composite body 3D. According to the composite body 3E, a disk shaped sintered body 11C and tube shaped sintered bodies 11A and 11B are fixed to the outer periphery of the conductor 2. A ring shaped protrusion 4 is formed onto the outer edge of the sintered body 11 C. According to the composite body 3F, a disk shaped sintered body 11D and tube shaped sintered bodies 11A and 11B are fixed onto the outer periphery of the conductor 2. A chamfered part 5 is formed on the outer edge of the sintered body 11D. According to the composite body 3G, a disk shaped sintered body 11 and tube shaped sintered bodies 11B and 11E are fixed onto the outer periphery of the conductor.

According to the present invention, the shape of the sintered body fixed to the current through conductor is not limited to a disk or a tube. For example, asterisk or gear shaped bodies 11F, 11G and 11H, shown in FIGS. 6(*a*), (*b*) and (*c*), respectively, may be fitted to the outer periphery of the conductor 2 and then sintered. Such sintered bodies having such shapes can be easily designed to have a large surface area and thus particularly suitable to an electrode radiator.

The present invention will be described further, referring to examples of application of a high pressure discharge lamps.

Figure 7:
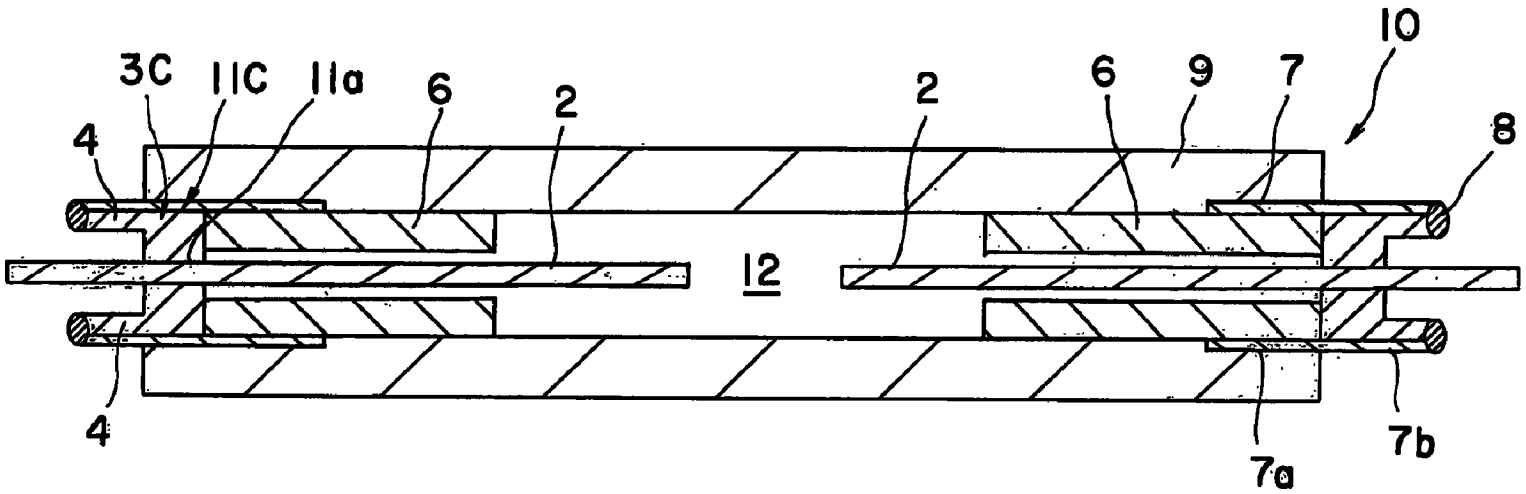
FIG. 7 is a cross sectional view schematically showing a luminous vessel for a high pressure discharge lamp obtained by applying the present invention, whose end portion is welded.

FIG. 7 is a cross sectional view schematically showing a high pressure discharge lamp 10 produced by applying the present invention. Both ends of a luminous vessel 9 made of a translucent material are sealed at the inside with a sealing member 11C. Specifically, an electrode and current through conductor 2 is inserted into each through hole 11*a* of each sealing member 11C. The sealing member 11C and current through conductor 2 are bonded with each other according to the present invention to provide the inventive composite body 3C. The composite bodies 3C are sealed in air tight manner, respectively. A ring shaped protrusion 4 is formed on the outer edge of each sealing member 3C.

On the other hand, an inner member 6 made of a brittle material is fixed to the inside of the end part of the luminous vessel 9 through a plate-shaped metal piece 7. The luminous vessel 9, plate-shaped metal piece 7 and inner member 6 are strongly bonded with each other according to a process described later. The edge of the plate-shaped metal piece 7 and the edge of the ring-shaped protrusion 4 are bonded with each other with an optional method such as welding as a numeral 8 in air-tight manner to obtain a luminous vessel for a high pressure discharge lamp. Predetermined luminous substances are sealed in an inner space 12 of the luminous vessel 9 for use as a luminous vessel for a high pressure discharge lamp.

Figure 8:
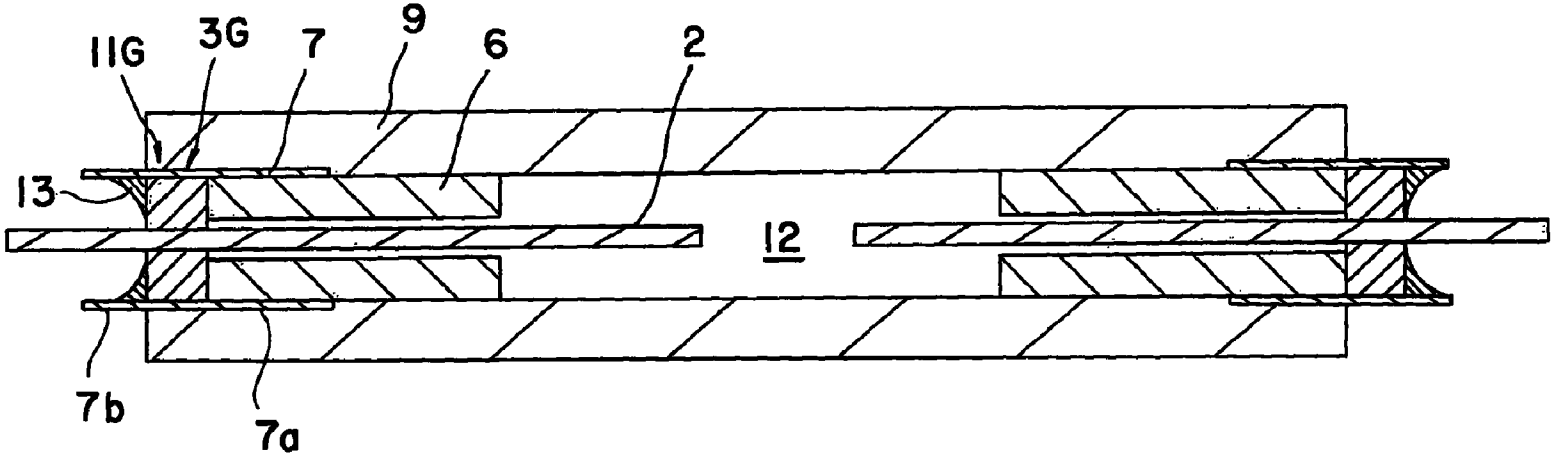
FIG. 8 is a cross sectional view schematically showing a luminous vessel for a high pressure discharge lamp obtained by applying the present invention, whose end portion is sealed with a sealing member 13.

The plate-shaped metal piece 7 has a clamped portion 7*a* pressed and clamped as described later and a non-clamped portion 7*b* protruding from the end part of the luminous vessel. The non-clamped part of the plate-shaped metal piece 7 is protruded from the end part of the luminous vessel, so that the sealing of the end part of the luminous vessel is generally facilitated. That is, when a sealing material such as a frit etc. is used for the sealing (for example as shown in FIG. 8), a sealing material may be adhered onto the inside face of the non-clamped portion 7*b*. Further, when the sealing is carried out by laser welding, such non-clamped portion assist the escape of heat generated during the welding process to prevent the concentration of heat in the luminous vessel and the crack formation therein and to prevent the leakage of welding material.

By applying the present invention to a luminous vessel for a high pressure discharge lamp as described above, the following effects can be further obtained. That is, according to the composite body 3C of the present invention, a solid electrode and current through conductor 2 is inserted and fixed into the end part of the luminous vessel 9 and inside of the sealing member 11C having a thermal expansion coefficient close to that of the plate-shaped metal piece 7 embedded in and strongly bonded to the inner member 6, so that the tip end of the conductor 2 functions as an electrode. Even when the whole of the conductor 2 is made of a material suitable as the electrode material such as tungsten, the sealing member 11C is strongly bonded to the conductor 2 in air tight manner so that the bonding is resistive against thermal cycles, according to the present invention. The whole of the conductor 2 can be formed of one kind of appropriate material such as tungsten to alleviate the need of bonding process of high melting point metals and thereby to considerably reduce the production cost.

In the case of a luminous vessel for a high pressure discharge lamp shown in FIG. 8, the electrode and current through conductor 2 is inserted into each through hole 11*a* of each sealing member 11G. The sealing member 11G and the current through conductor 2 are bonded according to the present invention to constitute the inventive composite body 3G. The composite bodies 3G are maintained in air-tight manner. On the other hand, an inner member 6 made of a brittle material is fixed to the inside of the end portion of the luminous vessel 9 through the plate shaped metal piece 7. The luminous vessel 9, plate-shaped metal piece 7 and inner member 6 are strongly bonded with each other according to the process described later. The inner surface of the plate-shaped metal piece 7 and the surface of the sealing member 11G are further sealed with a sealing material 13.

Such sealing material includes glass sealing materials and ceramic sealing materials, and may preferably be the following. For example, a frit material or mixed powder of oxides having a composition of Dy2O3:Al2O3:Si2O3=50-80:10-30:10-30 (weight percent) may be used.

Figure 9:
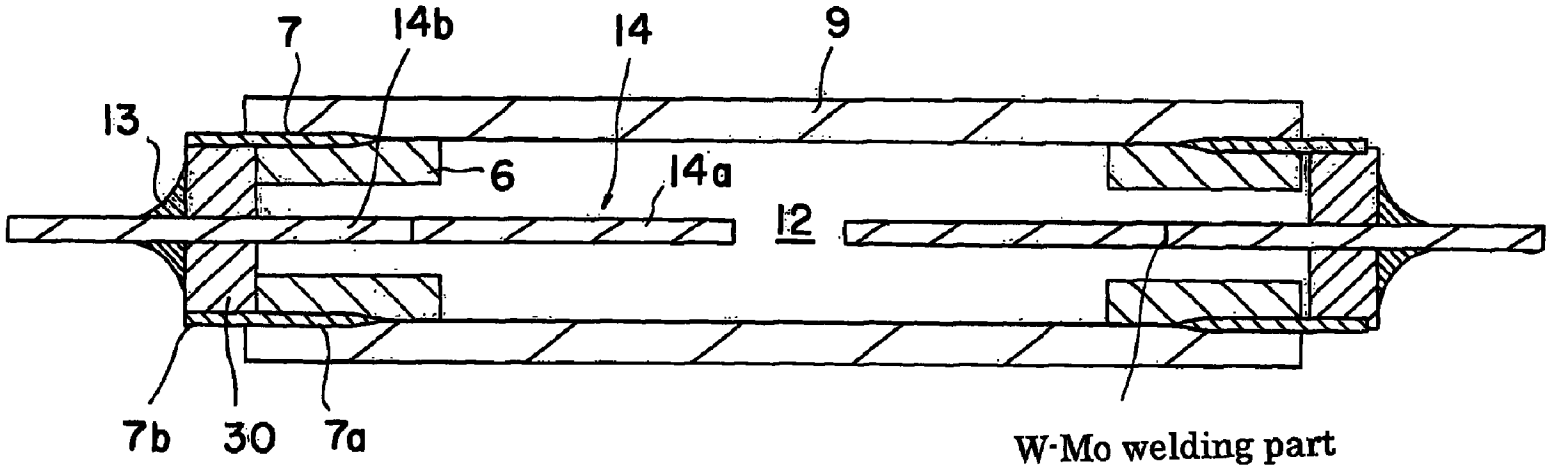
FIG. 9 is a cross sectional view schematically showing a luminous vessel for a high pressure discharge lamp out of the present invention, whose current through conductor having parts 14*a* and 14*b* made of different materials.

In the case of a luminous vessel for a high pressure discharge lamp shown in FIG. 9, the present invention is not applied to the fixing of a current through conductor 14. In this case, the bonding of a sealing member 30 for an end part and the current through conductor 14 is performed by a prior method, so that it is necessary to reduce the difference of thermal expansion coefficients of the sealing material for end part and current through conductor. For example, when the sealing material 30 for end part is made of molybdenum cermet, a sealing part 14*b* of the current through conductor is made of molybdenum whose thermal expansion coefficient is close to that of the cermet, and an end part 14*b* is made of tungsten. It is difficult, however, to strongly bond the connecting part of tungsten and molybdenum and requires a considerably high production cost.

Figure 6:
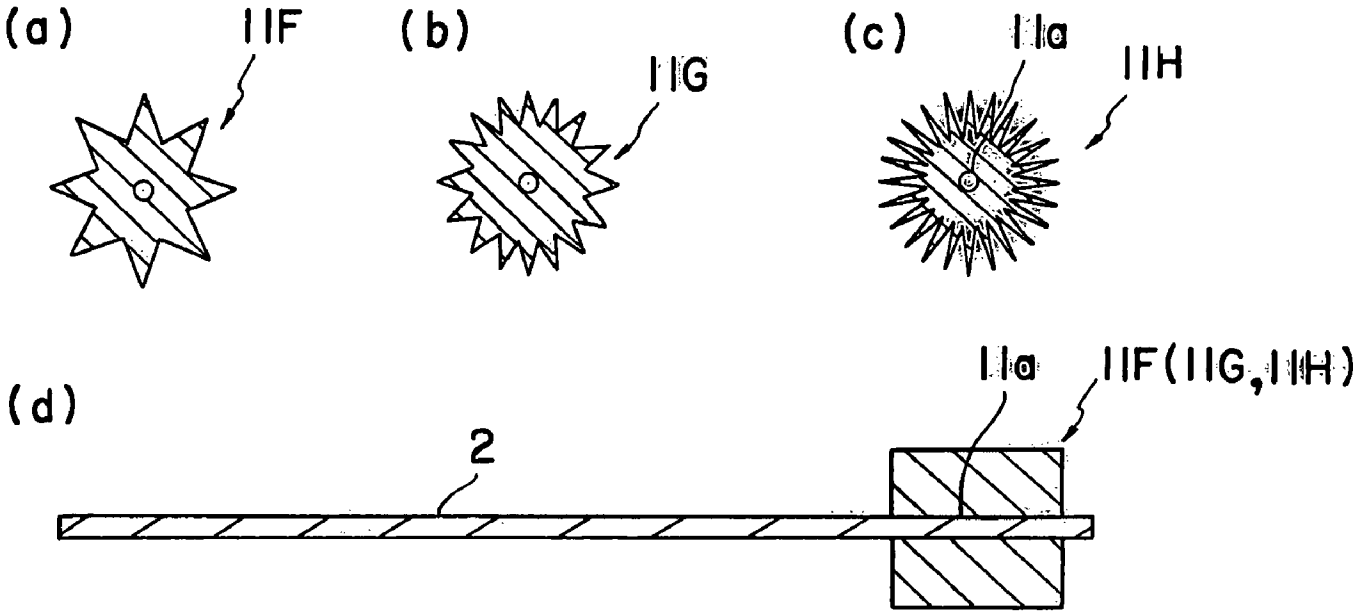
FIGS. 6(*a*), FIG. 6(*b*) and FIG. 6(*c*) are front views showing star-shaped-sintered bodies 11F, 11G and 11H, respectively.
Figure 10:
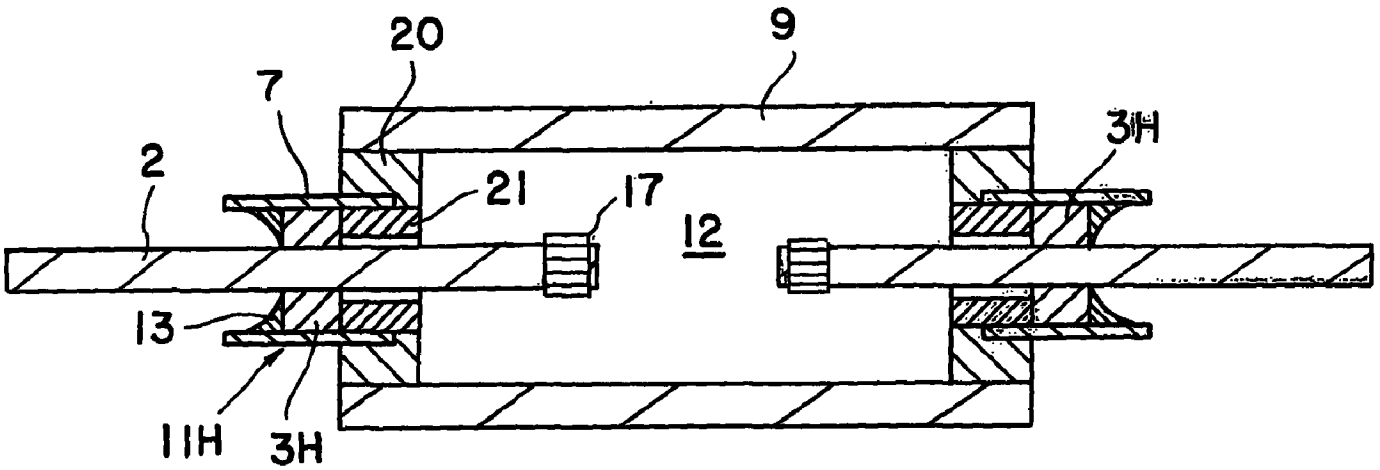
FIG. 10 is a cross sectional view schematically showing a luminous vessel for a high pressure discharge lamp obtained by applying the present invention.

According to an example of FIG. 10, an outer sealing member 20 is fixed to the inside of the end part of a luminous vessel 9, and a plate-shaped metal piece 7 is clamped with and pressed by the outer sealing member 20 and an inner sealing member 21, as described later. On the other hand, the electrode and current through conductor 2 and sealing member 11H are integrated according to the present invention to constitute a composite body 3H. A sealing material 13 is provided between the inner face of the plate-shaped metal piece 7 and sealing member 11H. The electrode radiator 17 of a shape of asterisk shown in FIG. 6 is fixed to the tip end of the electrode and current through conductor 2.

Figure 11:
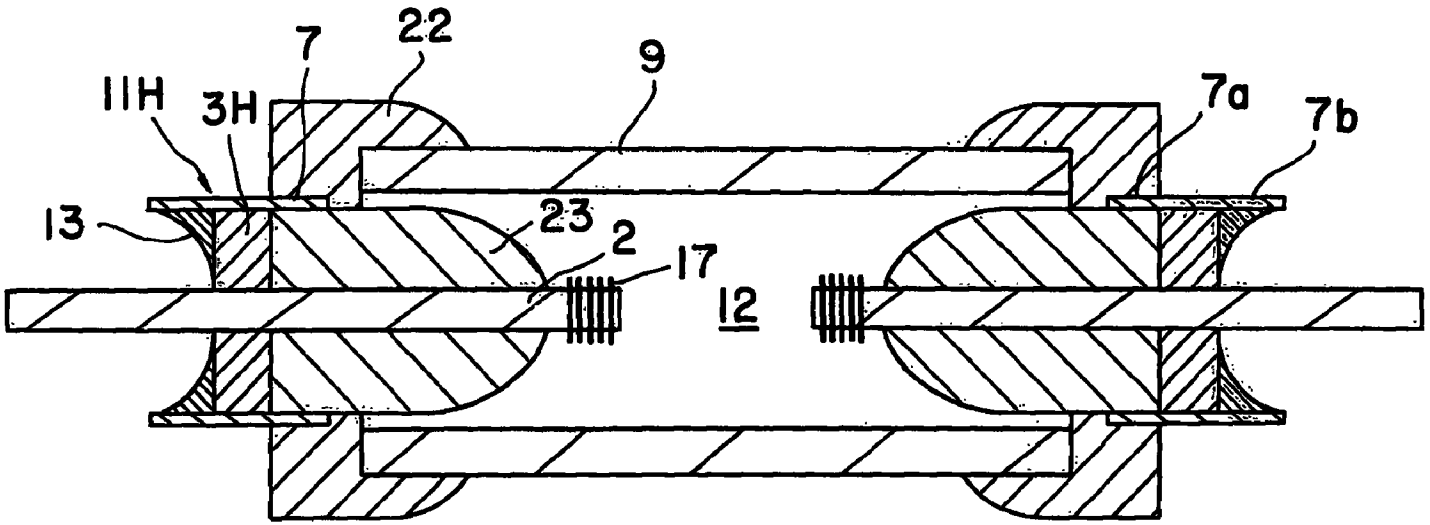
FIG. 11 is a cross sectional view schematically showing a luminous vessel for a high pressure discharge lamp obtained by applying the present invention.

According to an example of FIG. 11, an outer sealing member 22 is fixed to the outside of the end part of the luminous vessel 9, and the plate-shaped metal piece 7 is pressed by and clamped between the outer sealing member 22 and an inner sealing member 23, as described later. On the other hand, the electrode and current through conductor 2 and sealing member 11H are integrated according to the present invention to constitute a composite body 3H. A sealing material 13 is provided between the inner side of the plate-shaped piece 7 and sealing member 11H. A spiral electrode radiator 17 is fixed to the tip end of the electrode and current through conductor 2.

Figure 12:
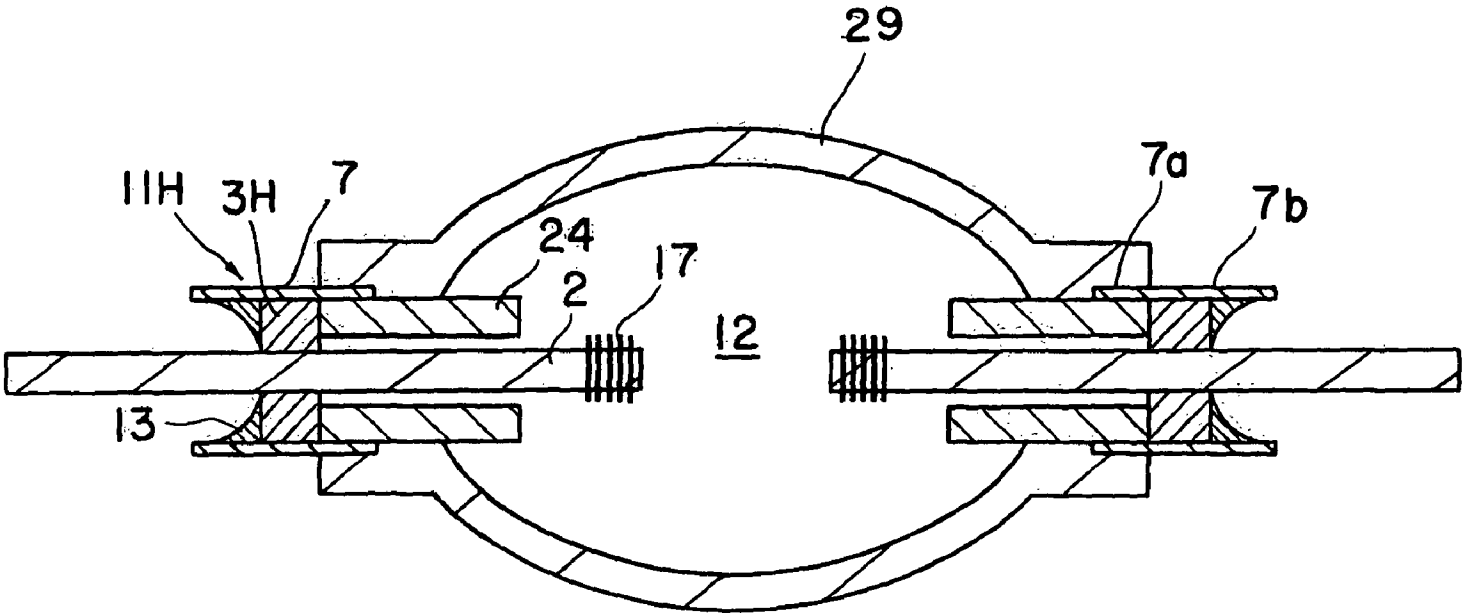
FIG. 12 is a cross sectional view schematically showing a luminous vessel for a high pressure discharge lamp obtained by applying the present invention.

FIG. 12 shows an example of applying the present invention to a luminous vessel of so-called elliptical type. A sealing member 24 is fixed to the inside of the end part of a luminous vessel 29, and the plate-shaped metal piece 7 is pressed by and clamped between the luminous vessel 29 and sealing member 24, as described later. On the other hand, the electrode and current through conductor 2 and sealing member 11H are integrated according to the present invention to constitute a composite body 3H. A sealing material 13 is provided between the inner side of the plate-shaped piece 7 and sealing member 11H. A spiral electrode radiator 17 is fixed to the tip end of the electrode and current through conductor 2.

Figure 13:
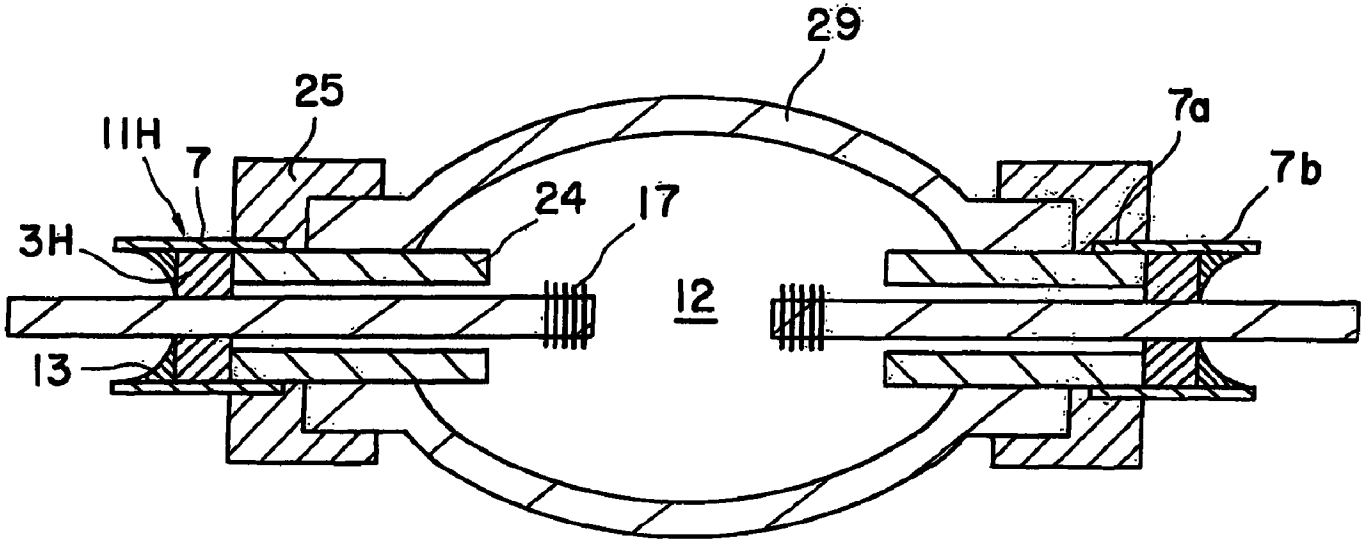
FIG. 13 is a cross sectional view schematically showing a luminous vessel for a high pressure discharge lamp obtained by applying the present invention.

FIG. 13 shows an example of applying the present invention to a luminous vessel of so-called elliptical type. An outer sealing member 25 is fixed to the outside of the end part of a luminous vessel 29, and the plate-shaped metal piece 7 is pressed by and clamped between the outer sealing member 25 and inner sealing member 24, as described later. On the other hand, the electrode and current through conductor 2 and sealing member 11H are integrated according to the present invention to constitute a composite body 3H. A sealing material 13 is provided between the inner side of the plate-shaped piece 7 and sealing member 11H. A spiral electrode radiator 17 is fixed to the tip end of the electrode and current through conductor 2.

Figure 14:
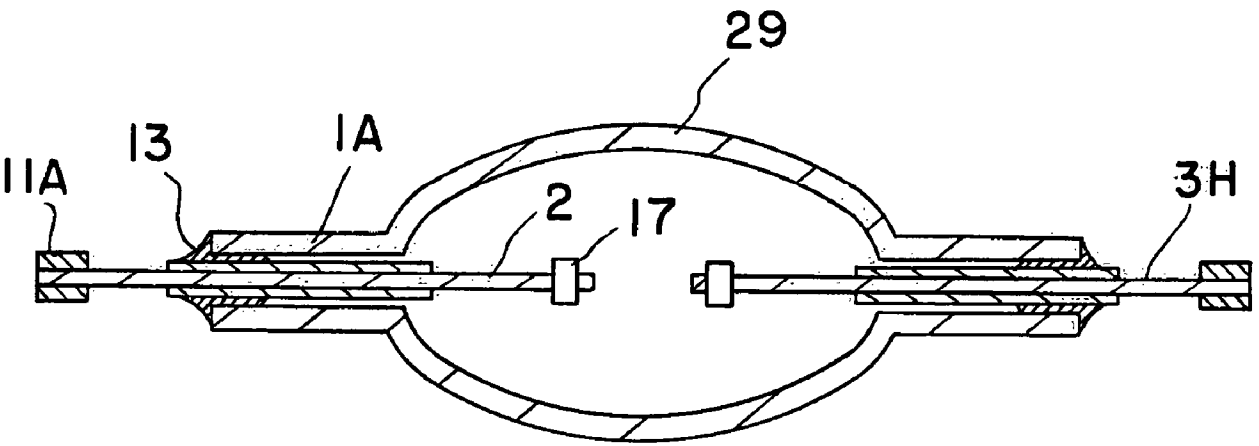
FIG. 14 is a cross sectional view schematically showing a luminous vessel for a high pressure discharge lamp obtained by applying the present invention.

FIG. 14 shows an example of applying the present invention to a luminous vessel of so-called elliptical type. The end part of the luminous vessel 29 is used as a lead through tube whose diameter is gradually lowered as a capillary. On the other hand, the electrode and current through conductor 2, a sealing material 13 and sleeve 1A, an end part 11A for welding and an electrode radiator 17 are integrated according to the present invention to constitute a composite body 3H. The sealing material 13 is provided between the inner face of the end capillary of the luminous vessel 29 and sleeve 1A. A gear-shaped electrode radiator 17 is fixed to the tip end of the electrode and current through conductor 2. Further, on the opposite side, the end part 11A for welding is fixed for facilitating the welding with a lead wire.

Figure 15:
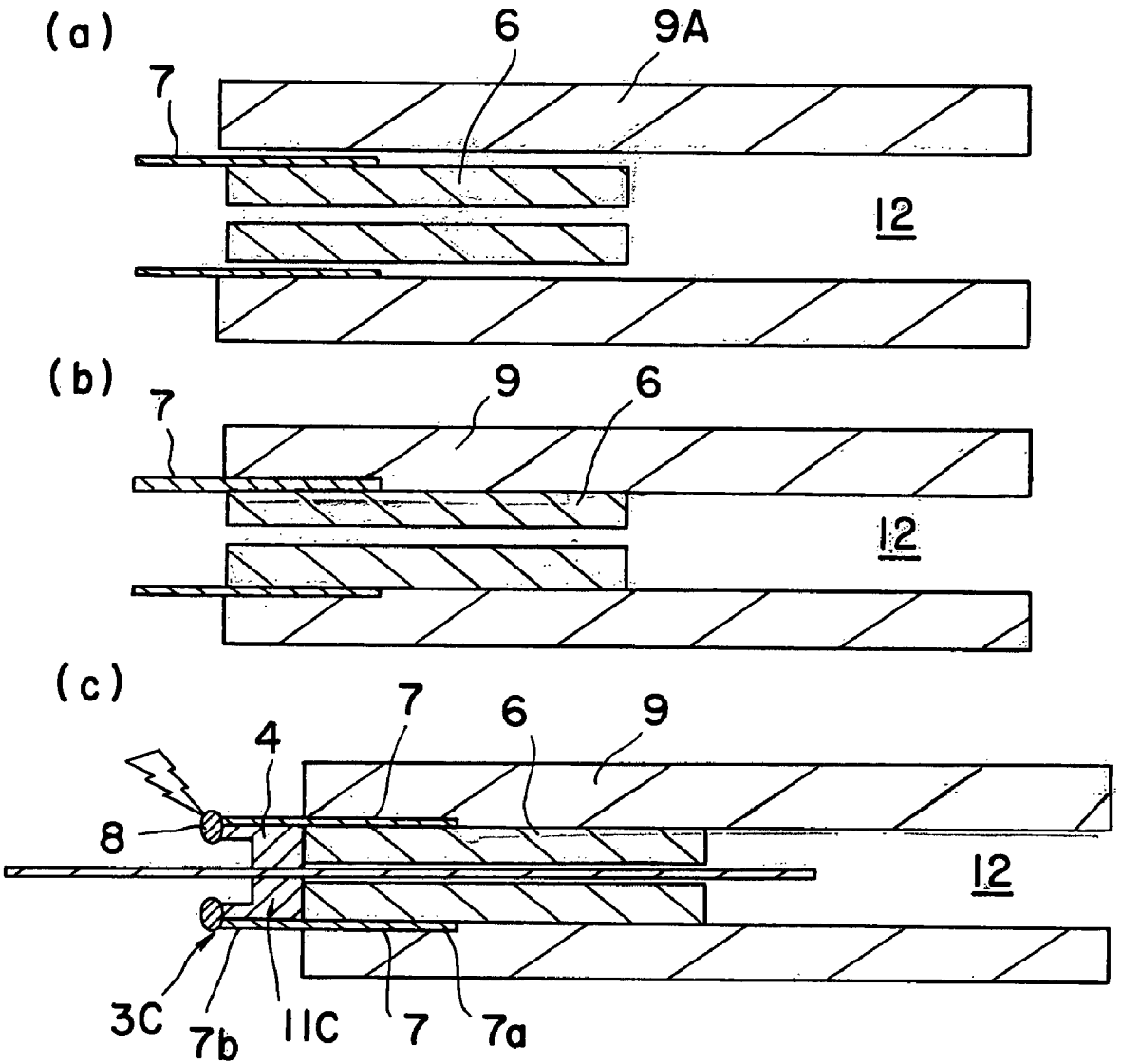
FIG. 15(*a*), FIG. 15(*b*) and FIG. 15(*c*) are cross sectional views schematically showing a process of fabricating a luminous vessel for a high pressure discharge lamp.

FIGS. 15(*a*) to (*c*) are cross sectional views schematically showing a process for assembling a luminous vessel for a high pressure discharge lamp according to the present invention. As shown in FIG. 15(*a*), a tube like plate-shaped metal piece 7 is inserted and sandwiched between a molded body 9A for a luminous vessel and an inner member 6. The molded body 9A is then sintered to sintering shrinkage so that the plate-shaped metal piece 7 is pressed and clamped by the luminous vessel 9 and sealing member 6 as shown in FIG. 15(*b*). On the other hand, according to the present invention, the composite body 3C of the electrode and current through conductor 2 (not shown) and the sintered body 11C are prepared as shown in FIG. 15(*c*). A ring-shaped protrusion 4 of the sintered body 11C is welded to the plate-shaped metal piece 7 to obtain a high pressure discharge lamp.

Figure 16:
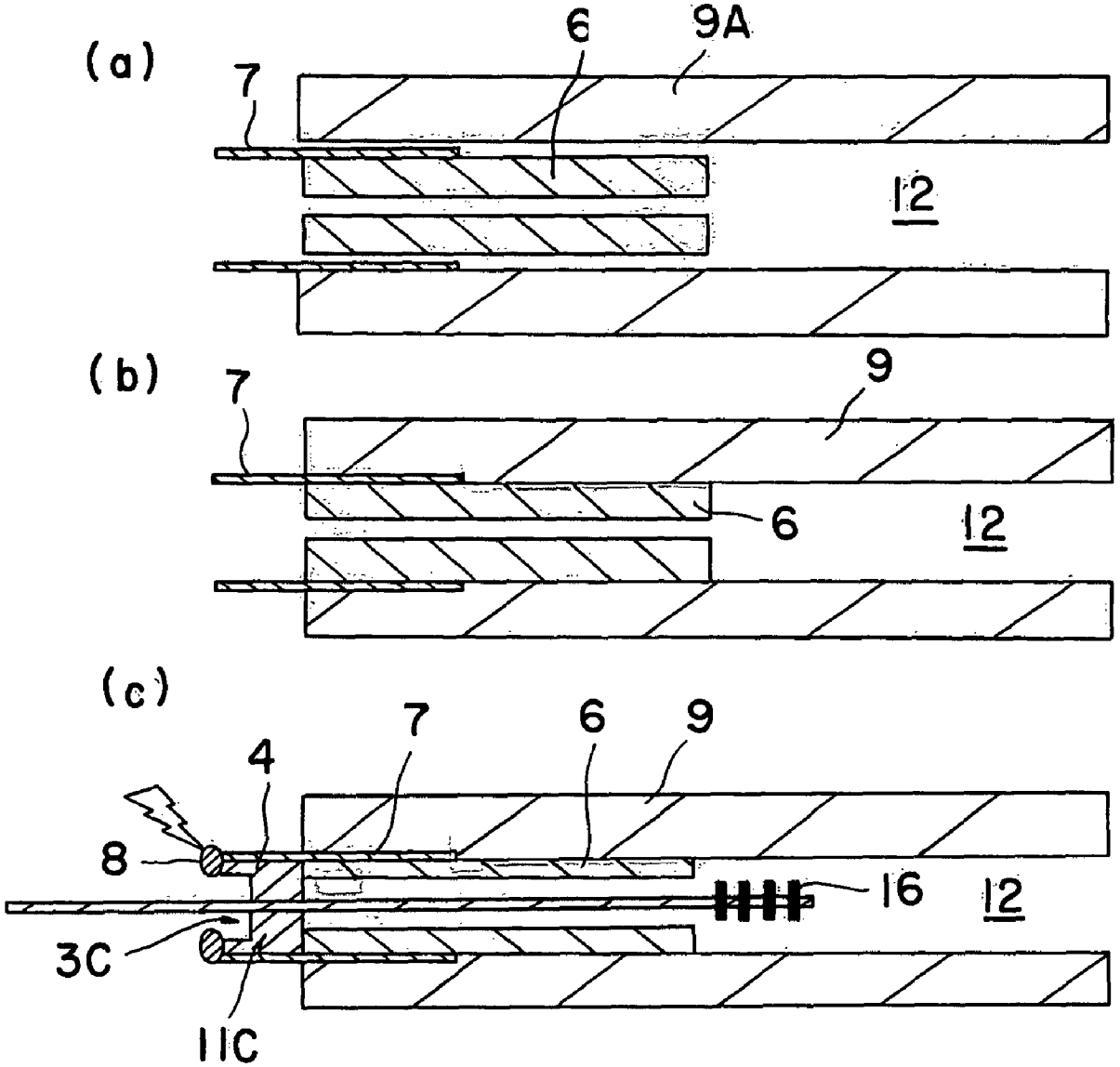
FIG. 16(*a*), FIG. 16(*b*) and FIG. 16(*c*) are cross sectional views schematically showing a process of fabricating a luminous vessel for a high pressure discharge lamp.

Further, according to examples shown in FIGS. 16(*a*) to (*c*), a luminous vessel for a high pressure discharge lamp is produced according to the same process as that shown in FIGS. 15(*a*) to (*c*). According to the present example, however, an electrode radiator 16 made of a plurality of small disks is provided at the tip end of the electrode and current through conductor 2.

Figure 17:
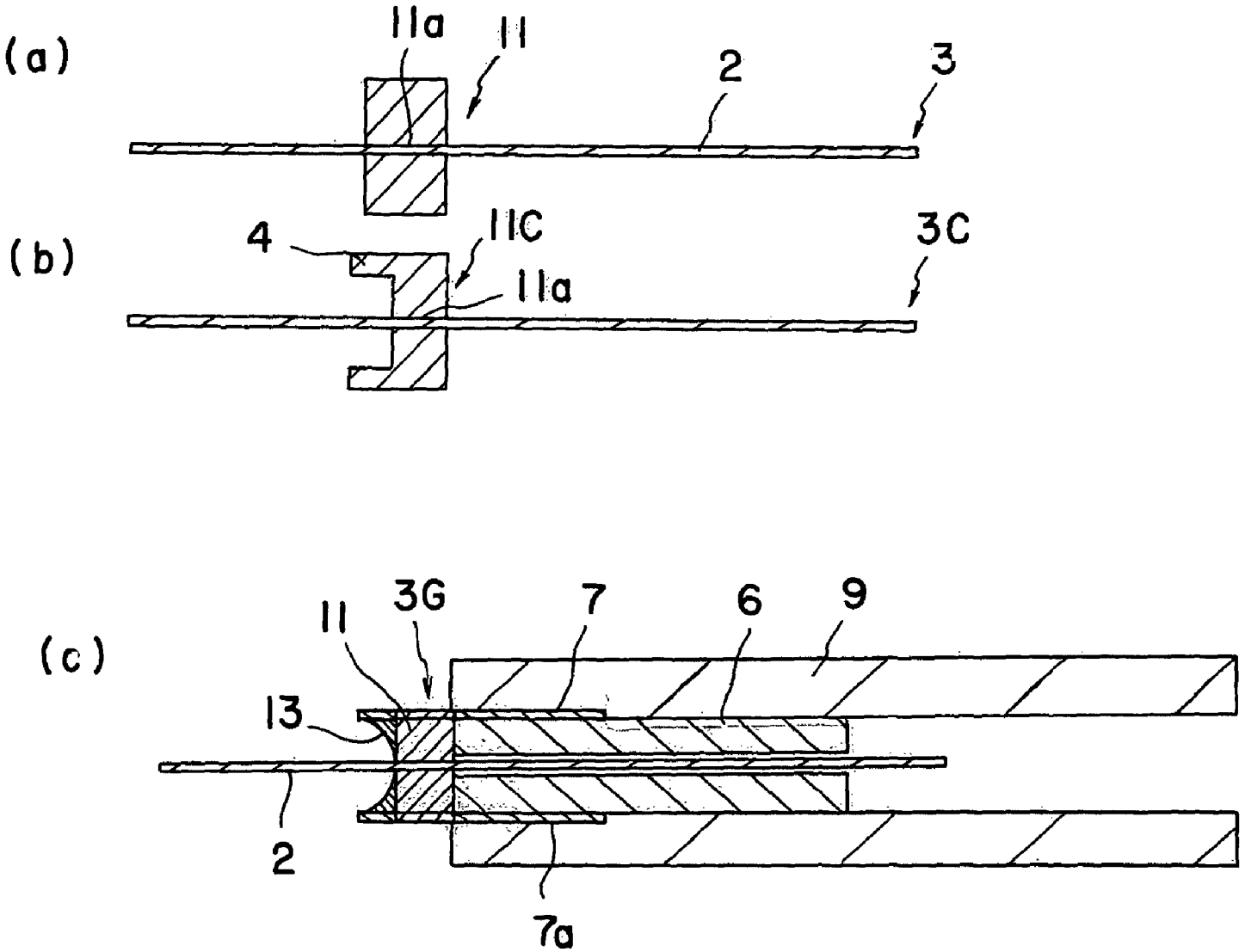
FIG. 17(*a*) and FIG. 17(*b*) are cross sectional views showing composite bodies 3 and 3C, respectively.

The electrode and current through conductor 2 is inserted into the through hole of a molded body having a predetermined shape to sinter the molded body to obtain a composite body, as shown in FIGS. 17(*a*) and (*b*). The thus obtained sintered body 11C is fixed, or welded, to the plate-shaped metal piece 7 with the sealing material 13, for example as shown in FIG. 17(*c*).

Figure 18:
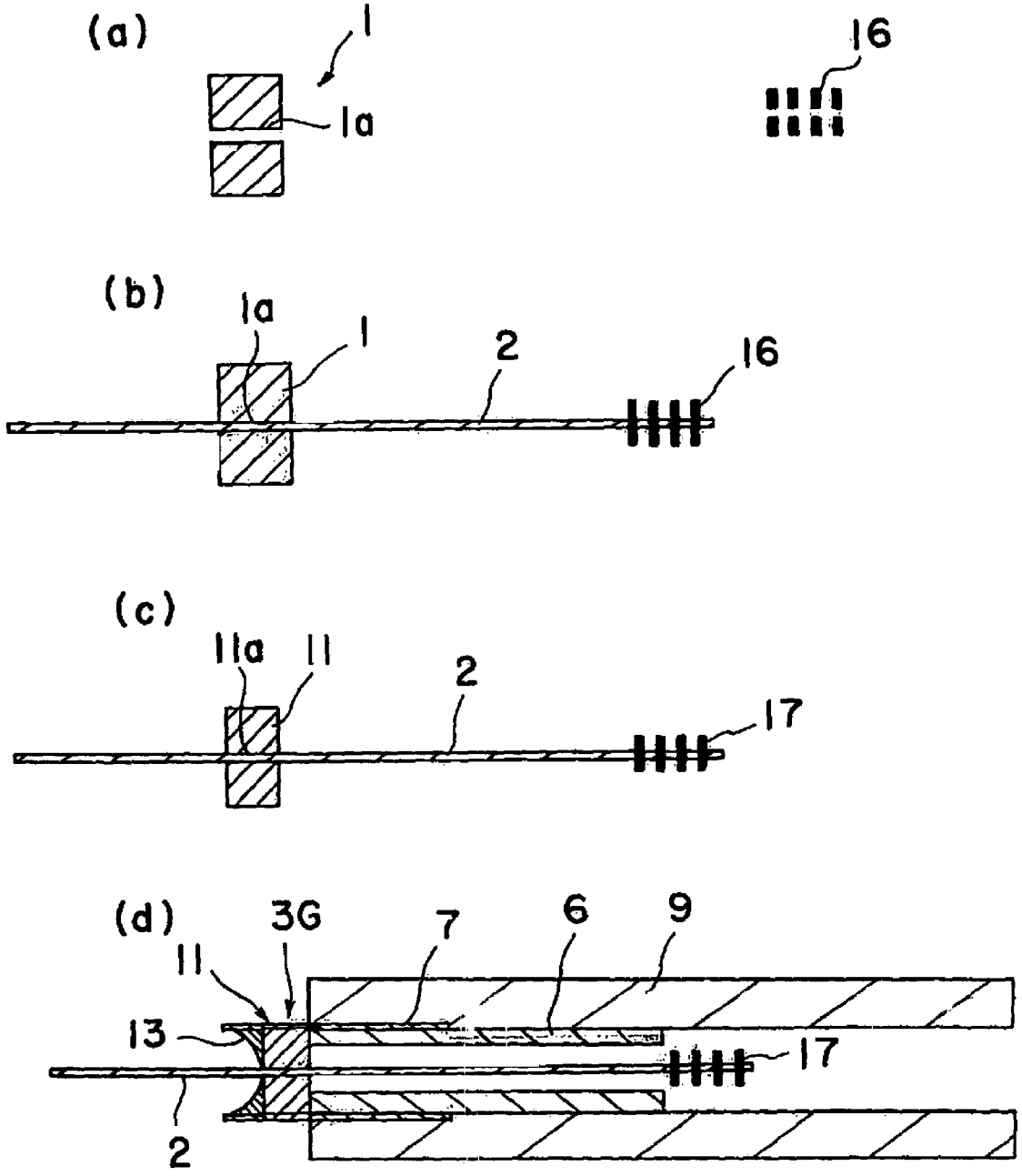
FIG. 18(*a*) is a cross sectional view showing a molded body 1 of a sealing member and a molded body 16 of an electrode.

According to an example of FIG. 18(*a*), the molded body 16 of the electrode radiator 17 is prepared, as well as the sealing member 11. As shown in FIG. 18(*b*), the electrode and current through conductor 2 is then inserted into the through hole 1*a* of the molded body 1 and inserted into the molded body 16 of the electrode radiator 17. The molded body 1 and molded body 16 for the electrode are then sintered so that the sintered sealing member 11 and electrode radiator 17 are fixed to the outer periphery of the electrode and current through conductor 2, as shown in FIG. 18(*c*). As shown in FIG. 18(*d*), the sealing member 11 is then fixed to the plate-shaped metal piece 7 to obtain a high pressure discharge lamp.

In a high pressure discharge lamp, the brittle materials forming the sealing member for pressing and clamping the plate-shaped metal piece and luminous vessel is not particularly limited, and include glass, ceramics, single crystal and cermet.

Such glass includes quartz glass, aluminum silicate glass, borosilicate glass, silica-alumina-lithium series crystallized glass etc. The ceramics includes, for example, ceramics having corrosion resistance against a halogen series corrosive gas, and may preferably be alumina, yttria, yttrium-aluminum garnet, aluminum nitride, silicon nitride or silicon carbide. Single crystals of any of the materials selected from the above may be used.

The cermet may be composite materials of a ceramics such as alumina, yttria, yttrium-aluminum garnet and aluminum nitride and a metal such as molybdenum, tungsten, hafnium and rhenium. The single crystal includes those being optically transparent in visual ray band, such as diamond (single crystal of carbon) or sapphire (Al2O3 single crystal).

According to a luminous vessel for a high pressure discharge lamp, the plate-shaped metal piece may preferably be pressed and clamped at both sides in the direction of thickness with brittle materials having thermal expansion coefficients being substantially equivalent or same with each other. It is thus possible to avoid the generation of stress between the opposing brittle material portions. Stress generated in the metal member provides substantially equivalent distribution with respect to the central plane passing through the center of the metal member in the direction of thickness. Further, the metal member has a thickness considerably smaller than that of the brittle material, so that the stress generated in the metal member is relaxed by the plastic deformation of the metal. It is thus possible to avoid the possibility of critical damages such as bending and crack formation of the metal member or considerable deformation, even after the press clamping and under the use condition of temperature change.

According to the high pressure discharge lamp described above, the stress generated along the contact interface between the plate-shaped metal piece and the brittle material is relaxed due to the deformation of the plate-shaped metal piece.

The stress along the contact interface of the clamped portion and brittle material is generated, for example, due to the following mechanism. The thermal expansion coefficient of the metal material is represented by "$\alpha$1", the Young's modulus of the metal is represented by "E1", the thermal expansion coefficient of the brittle material is represented by "$\alpha$2" and the Young's modulus of the brittle material is represented by "E2". It is now provided that the metal material is embedded in the brittle material, and the brittle material is then sintered at a sintering temperature "T1" and cooled to room temperature so that the metal material is pressed and clamped with the brittle material. In this case, it is provided that both materials would not be deformed and would not slide along the interface, the stress "$\sigma$1" generated in the metal is represented by the following formula.

$$\sigma 1 \propto E1 \times (T1-\text{room temperature}) \times (\alpha 1-\alpha 2) \quad (1)$$

The stress "$\sigma$2" generated in the brittle material is similarly represented by the formula.

$$\sigma 2 \propto E2 \times (T1-\text{room temperature}) \times (\alpha 2-\alpha 1) \quad (2)$$

The combination of molybdenum and alumina is taken for the example, the thermal expansion coefficient and Young's modulus of molybdenum are about 5 ppm/° C. and about 330 GPa, respectively. The thermal expansion coefficient and Young's modulus of alumina are about 8 ppm/K and about 360 GPa, respectively. For example, when alumina is sintered at 1500° C. and then cooled to room temperature, a compressive stress of about 1500 MPa is generated in molybdenum, provided that there is no plastic deformation of molybdenum. Similarly, a tensile stress of about 1600 MPa is generated in alumina.

Both of the stress values are beyond the strengths of the corresponding materials, so that such composite structure cannot be produced because of the fracture along the interface of the brittle material and metal.

However, a stress generated in the metal beyond the yield strength of the metal results in the plastic deformation. The magnitude of the deformation until the fracture is represented by the elongation. Such elongation generally takes a considerably large value of several percent to several tens percent.

The thickness of the metal material is made relatively smaller than that of the ceramic material, so as to generate a stress larger than the yield strength of the metal to cause the plastic deformation, so that the overall stress generated due to the difference of the thermal expansion coefficients is relaxed.

For example, it is provided that the metal member is made of a thin plate of molybdenum having a thickness of 100 micrometer, and the ceramic block is made of alumina having a thickness of 10 mm, the strain in the molybdenum plate required for deforming the molybdenum plate and for relaxing the stress is represented by the following formula (3).

$$\epsilon = (T1-\text{room temperature}) \times (\alpha 1-\alpha 2) \times 0.5\% \quad (3)$$

The amount of deformation in the direction of the thickness is represented by the formula.

$$\Delta t = \epsilon \times t \times 0.5 \text{ micrometer} \quad (4)$$

It is thus possible to relax the overall stress by a considerably small amount of deformation.

The combination of platinum and alumina is taken for example, the thermal expansion coefficient and Young's modulus of platinum are about 9 ppm/K and about 170 GPa, respectively, and the thermal expansion coefficient and Young's modulus of alumina are about 8 ppm/° C. and about 360 GPa, respectively. For example, when alumina is sintered at 1500° C. and then cooled to room temperature, a tensile stress of about 250 MPa is generated in platinum member provided that no plastic deformation is generated in platinum.

Similarly, a compressive stress of about 530 MPa is to be generated in the alumina member.

Also in this case, when the platinum member is made of a thin plate having a thickness of 100 mm and the alumina member is made of a block having a thickness of 10 mm, the strain in the platinum member required for deforming the platinum thin plate and for relaxing it is represented by the above formula (3) and about 0.1 percent in this case. Although a tensile stress is generated in the platinum member in the direction of the pressing and clamping, only 0.1 percent of deformation in the direction of the depth of the platinum plate can relax the tensile stress. The amount of deformation is only 10 μm, provided that the depth of the pressing and clamping is 10 mm.

As described above, the stress is generated mainly due to the difference of thermal expansion coefficients of the brittle and metal materials in the composite structure of the materials and thus reflects a strain of about 1 percent or lower. On the other hand, the yield strength of the metal material is lower than the tensile strength and the elongation required for the fracture is several percent to several tens percent. The thickness of the metal material is made relatively smaller than that of the brittle material so as to generate a stress larger than the yield strength of the metal to cause the plastic deformation for relaxing the difference of the thermal expansion coefficients. Even in this case, the amount of deformation is in a range of the elongation so that the fracture of the metal material is avoided. Further, the metal material is deformed to relax the stress generated in the brittle material to provide a composite structure of the brittle material and metal. When the materials are integrated utilizing sintering shrinkage requiring thermal process at a high temperature, the relaxing of the stress can be performed also due to deformation of the metal material such as high temperature creep.

According to a preferred embodiment, the difference of the thermal expansion coefficients of the brittle materials on the both side of the plate-shaped metal piece may preferably be 2 ppm or lower and more preferably be 1 ppm or lower. Most preferably, the thermal expansion coefficients are the same. The thermal expansion coefficients of the both brittle materials may be thus adjusted to further improve the stability and reliability of the inventive structure of brittle material and metal against thermal cycles.

According to a preferred embodiment, brittle materials on the both sides for pressing and clamping the clamped portion of the plate-shaped metal piece is composed of sintered bodies having different sintering shrinkages, so that the plate-shaped metal piece is pressure bonded with the difference of shrinkage during the sintering process. A preferred value of the difference of shrinkages will be described below.

Alternatively, according to a preferred embodiment, brittle materials on the inner side for pressing the material of the clamped portion of the plate-shaped metal piece may be selected from those not subjected to sintering shrinkage such as a sintered body, a single crystal and glass, and the outer brittle material may be composed of a molded body subjected to sintering shrinkage.

According to a preferred embodiment, the thickness of the clamped part of the plate-shaped metal piece may preferably be 1000 μm or smaller, and more preferably be 200 μm or smaller. The thickness of the plate-shaped metal piece may be made smaller as described above, to cause the deformation of the metal piece. It is thus possible to reduce the stress generated between the metal piece and brittle material and to further improve the air-tightness of the luminous vessel. If the plate-shaped metal piece is too thin, however, the strength as the structural body tends to be insufficient. On the viewpoint, the thickness of the metal piece may preferably be 20 μm or larger, and more preferably be 50 μm or larger.

According to a preferred embodiment, the outer brittle material pressing and clamping the clamped portion of the plate-shaped metal piece has a thickness of 0.1 mm or larger. It is thus possible to sufficiently increase the pressure from the brittle material onto the plate-shaped metal piece radially, so as to further improve the air-tightness of the luminous container. On the viewpoint, the thickness of the outer brittle material may preferably be 0.5 mm or larger.

The method of manufacturing a luminous vessel is not particularly limited. The luminous vessel may be divided to two parts: barrel and end parts. The barrel part may be molded by extrusion and the end part may be molded with slurry casting or injection molding. The thus obtained molded bodies are molded with each other before the dewaxing and thus subjected to sintering so that the bodies are integrated. Further, (2) the luminous vessel may be molded with lost wax method such as gel cast molding, so as to provide a sealing structure of the end part where the design of the barrel portion of the luminous vessel is not limited.

Further, in a metal halide lamp, Mo, W, Re or the like has been used on the viewpoint of corrosion resistance. In a high pressure sodium lamp, Nb may be applied for the metal member. Further, as described above, Nb may be applied in a super high pressure mercury lamp.

The luminous containers may be sealed as follows to provide a discharge lamp.

(1) Metal Halide Lamp (Illumination for General Lighting Purpose)

Hg (not essential component), the iodide of a metal (Na, rare earth element or the like) are supplied through a hole of a metal cap (metal cap itself may have a guiding part) made of Mo in Ar atmosphere of 50 to 200 mbar and Mo or W electrode is then inserted and sealed by welding such as TIG welding or laser welding.

(2) Metal Halide Lamp (Automobile Use, Point Light Source)

Metal iodide and Hg (not essential component) are sealed as described in (1). 7 to 20 bar of Xe is used as a starter gas depending on the conditions. Particularly in the case of the present invention, it is possible to completely prevent the evaporation of luminous substances such as a starter gas, because the sealing can be completed in a very short time and at a low temperature. The material of the shell part may be conventional translucent alumina and may preferably be YAG, sapphire, polycrystalline alumina having a grain diameter of 10 μm or smaller or the like having a high linear transmittance.

(3) High Pressure Na Lamp

Nb is used for the metal cap. The electrode is made of Mo, W or Nb welded with each other. The luminous substance may be Na—Hg amalgum and a starter gas such as Ar or the like or Xe in the case of no Hg used. Particularly when an auxiliary electrode is used on the surface of the tube (irrespective of the kind of the electrode such as coil winding, printing by metallizing or the like), an insulating means may be provided on the auxiliary electrode depending on the cases for preventing the shortcut of the electrode supporting member or the like and auxiliary electrode.

(4) Super High Pressure Mercury Lamp

The material of the shell part may preferably be YAG, sapphire or polycrystalline alumina having a grain diameter of 10 μm or lower having a high linear transmittance. The luminous substances include Hg and Br. Nb as well as Mo and W may be used for the metal cap, and the welding method is the same as described above.

EXAMPLES

Example 1

A composite body 3 was produced according to the process described referring to FIGS. 1(*a*) to (*d*). Specifically, 15 weight parts of an organic solvent, 5 weight parts of a binder and 2 weight parts of a lubricant were added to 100 weight parts of molybdenum metal powder having an average particle diameter of 2 micron and kneaded to clay, which was further kneaded with a vacuum clay kneader so that the clay does not include air. The clay was then extruded using a metal mold for extrusion and then dried to prepare a molded body 1 of molybdenum metal powder having a predetermined length. The cross sectional shape of the extruded molded body 1 was substantially circular, and a hole 1*a* was formed in the longitudinal direction having a diameter substantially same as that of a tungsten wire to be integrated. Such hole may be formed by fixing a core material in the center of the metal mold for extrusion. Alternatively, when the length of the molded body is small, after the solid molded body extruded is cut into a predetermined length, the molded body may be processed by mechanical processing with a drill to form the hole. Such cutting to a predetermined length may be performed before or after the drying process.

The thus produced molded body 1 of molybdenum metal was heated at 600° C. in air to remove the binder and lubricant by thermal decomposition from the molded body in advance.

A tungsten wire 2 having a length of 40 mm was inserted into the central hole 1*a* of the molded body 1 of molybdenum powder to provide an assembly, which was then sintered at 1800° C. in hydrogen atmosphere to sinter the molded body of molybdenum metal powder. The molded body of molybdenum metal powder was converted to a dense sintered body of molybdenum metal without open pores after the sintering. At the same time, the sintering of the molded body of molybdenum metal provides the shrinkage of volume and the sintering action so that the sintered body of molybdenum metal and tungsten rod are adhered at the interface and integrated to obtain a composite body 3 having excellent air-tightness.

The thus obtained structure having the tungsten rod and molybdenum metal member integrated with each other is suitable as, for example, an electrode and current through conductor for a high pressure discharge lamp.

Example 2

Integration with a Press Molded Member

A composite body 3C shown in FIGS. 4(*b*), (*d*) and (*e*) was produced. Specifically, 3 parts of binder and 1.5 parts of a plasticizer were added to 100 parts, of molybdenum metal powder having an average particle diameter of 2 micrometer to prepare granulated powder. The granulated powder was subjected to press molding at a uniaxial pressure of 1000 kg/cm$^2$ and then dried to prepare a molded body 1C of molybdenum metal having a predetermined shape.

The press molded body 1C substantially has a cross sectional shape of a disk with a hole 1*a* formed at the central part having a diameter substantially same as that of a tungsten wire to be integrated. The hole may be formed by setting a core material at the center of a die set metal mold for the press molding, or by mechanically processing a solid and disk shaped molded body with a drill when the thickenss of the molded body is small.

In the case of press molding, it is possible to mold a thin rib 4 in or facet part 5 in the corner of a molded body by adjusting the structure of a die set metal mold.

The thus obtained molded body 1 of molybdenum metal powder was then heated at 600° C. in air atmosphere to remove the binder and plasticizer from the molded body by thermal decomposition.

A tungsten wire 2 having a length of 40 mm was inserted into the central hole 1*a* of the molded body 1 of molybdenum powder to provide an assembly, which was then sintered at 1800° C. in hydrogen atmosphere to sinter the molded body of molybdenum metal powder. The molded body of molybdenum metal powder was converted to a dense sintered body of molybdenum metal without open pores after the sintering. At the same time, the sintering of the molded body of molybdenum metal provides the shrinkage of volume and the sintering action so that the sintered body of molybdenum metal and tungsten rod are adhered at the interface and integrated to obtain a composite body 3 having excellent air-tightness.

The thus obtained structure having the tungsten rod and molybdenum metal member integrated with each other is suitable as, for example, an electrode and current through conductor for a high pressure discharge lamp.

Example 3

Integration with a Molded Body Molded by Extrusion

A composite body 3A shown in FIGS. 3(*a*) to (*c*) was produced. Specifically, 20 parts of an organic solvent, 5 parts of a binder and 2 parts of a lubricant were added to 100 parts of mixed powder composed of 70 volume percent of molybdenum metal powder having an average particle diameter of 2 micron and 30 volume parts of alumina (aluminum oxide) having an average particle diameter of 0.3 micron and kneaded to clay. The clay was further kneaded with a vacuum clay kneader so that the clay does not include air. The clay was then extruded using a metal mold for extrusion and then dried to prepare a molded body 1A of the mixed powder of molybdenum metal and alumina having a predetermined length.

The cross sectional shape of the extruded and molded body 1A was substantially disk-shaped and with a hole formed at the central part having a diameter substantially same as that of a tungsten wire to be integrated. The hole may be formed by setting a core material at the center of a die set metal mold for the press molding. Alternatively, the hole may be formed in the molded body extruded as a solid rod by mechanically processing the molded body with a drill having a small diameter after the molded body is cut at a predetermined length when the molded body is short. The cutting to a predetermined length may be made either of before and after the drying.

The thus obtained molded body of the mixed powder of molybdenum metal and alumina was then heated at 600° C. in air atmosphere to remove the binder and lubricant from the molded body by thermal decomposition.

A tungsten wire 2 having a length of 40 mm was inserted into the central hole 1*a* of the molded body 1A of the mixed powder of molybdenum metal and alumina to provide an assembly, which was then sintered at 1800° C. in hydrogen atmosphere to sinter the molded body of the mixed powder of molybdenum metal and alumina. The molded body of the mixed powder of molybdenum metal and alumina was converted to a dense sintered body of the cermet without open pores after the sintering. At the same time, the sintering of the molded body of the mixed powder of molybdenum metal and alumina provides the shrinkage of volume and the sintering action so that the sintered body of molybdenum metal and tungsten rod are adhered at the interface and integrated to obtain a composite body having excellent air-tightness.

The thus obtained structure having the tungsten rod and the cermet member integrated with each other is suitable as, for example, an electrode and current through conductor for a high pressure discharge lamp.

Example 4

Integration with a Molded Body Molded by Extrusion

A composite body shown in FIGS. 6(*a*) and (*d*) was produced. Specifically, 20 parts of an organic solvent, 5 parts of a binder and 2 parts of a lubricant were added to 100 parts of mixed powder composed of 80 volume percent of tungsten metal powder having an average particle diameter of 2 micron and 20 volume parts of alumina (aluminum oxide) having an average particle diameter of 0.3 micron and kneaded to clay. The clay was further kneaded with a vacuum clay kneader so that the clay does not include air. The clay was then extruded using a metal mold for extrusion and then dried to prepare a molded body 11F of the mixed powder of tungsten metal and alumina having a predetermined length.

The cross sectional shape of the extruded and molded body 11F of the mixed powder of tungsten metal and alumina was substantially gear-shaped with films and with a hole formed longitudinally at the central part having a diameter substantially same as that of a tungsten wire to be integrated. The hole may be formed by setting a core material at the center of a die set metal mold for the press molding. Alternatively, the hole may be formed in the molded body extruded as a solid rod by mechanically processing the molded body with a drill having a small diameter after the molded body is cut at a predetermined length when the molded body is short. The cutting to a predetermined length may be made either of before and after the drying.

The thus obtained molded body of the mixed powder of tungsten metal and alumina was then heated at 600° C. in air atmosphere to remove the binder and lubricant from the molded body by thermal decomposition.

A tungsten wire 2 having a length of 40 mm was inserted into the central hole of the molded body of the mixed powder of tungsten metal and alumina to provide an assembly, which was then sintered at 1800° C. in hydrogen atmosphere to sinter the molded body of the mixed powder of tungsten metal and alumina. The molded body of the mixed powder of tungsten metal and alumina was converted to a dense cermet sintered body without open pores after the sintering. At the same time, the sintering 11 F of the molded body of the mixed powder of tungsten metal and alumina provides the shrinkage of volume and the sintering action so that the sintered body 11F of the mixed powder and tungsten rod are adhered at the interface and integrated. The thus obtained structure having the tungsten rod and the member of cermet of tungsten metal and alumina integrated with each other is suitable as, for example, an electrode and current through conductor for a high pressure discharge lamp having a high performance electric radiator.

Example 5

A composite body was produced according the same procedure as the example 1. The diameter of the tungsten rod 2, the outer diameter of the molded body before sintering, the inner diameter, thickness and length were variously changed as shown in table 1. The experiments were conducted according to the same procedure as the example 1 to obtain the results shown in table 2.

TABLE 1 dimensions of molded bodies before sintering

| | Tungsten | Molybdenum Molded body | | | |
|---|---|---|---|---|---|
| Example No. | Rod Diameter (mm) | Diameter mm | Inner Diameter Mm | Thickness mm | Length mm |
| 1-1 | 5 | 10 | 5.1 | 2.45 | 10 |
| 1-2 | 4 | 10 | 4.1 | 2.95 | 5 |
| 1-3 | 3 | 7 | 3.05 | 1.98 | 10 |
| 1-4 | 2 | 5 | 3.05 | 0.98 | 5 |
| 1-5 | 1.5 | 4.5 | 1.55 | 1.48 | 3 |
| 1-6 | 1 | 1.5 | 1.05 | 0.23 | 5 |
| 1-7 | 1 | 2 | 1.1 | 0.45 | 3 |
| 1-8 | 0.9 | 2.5 | 0.95 | 0.78 | 5 |
| 1-9 | 0.8 | 2 | 0.85 | 0.58 | 4 |
| 1-10 | 0.7 | 1.1 | 0.75 | 0.18 | 13 |
| 1-11 | 0.5 | 1.5 | 0.55 | 0.48 | 3 |
| 1-12 | 0.3 | 1.5 | 0.32 | 0.59 | 3 |
| 1-13 | 0.2 | 1 | 0.21 | 0.4 | 2 |

TABLE 2

Dimensions after sintering

| | | Molybdenum sintered body | | | | |
|---|---|---|---|---|---|---|
| Example No. | Tungsten Rod Diameter (mm) | Diameter mm | Inner Diameter Mm | Thickness mm | Length Mm | Air-Tightness atm · cc · $sec^{-1}$ |
| 1-1 | 5 | 8.8 | 5 | 1.9 | 7.5 | $10^{-8}$ |
| 1-2 | 4 | 8.6 | 4 | 2.3 | 3.8 | $10^{-8}$ |
| 1-3 | 3 | 6 | 3 | 1.5 | 7.5 | $10^{-9}$ |
| 1-4 | 2 | 4.2 | 2 | 1.1 | 3.8 | $10^{-9}$ |
| 1-5 | 1.5 | 3.7 | 1.5 | 1.1 | 2.3 | $10^{-9}$ |
| 1-6 | 1 | 1.38 | 1 | 0.19 | 3.8 | $10^{-9}$ |
| 1-7 | 1 | 1.8 | 1 | 0.4 | 2.3 | $10^{-9}$ |
| 1-8 | 0.9 | 2.1 | 0.9 | 0.6 | 3.8 | $10^{-9}$ |
| 1-9 | 0.8 | 1.8 | 0.8 | 0.5 | 3 | $10^{-9}$ |
| 1-10 | 0.7 | 1.0 | 0.7 | 0.15 | 10 | $10^{-9}$ |
| 1-11 | 0.5 | 1.3 | 0.5 | 0.4 | 2.3 | $10^{-9}$ |
| 1-12 | 0.3 | 1.3 | 0.3 | 0.5 | 2.3 | $10^{-9}$ |
| 1-13 | 0.2 | 0.8 | 0.2 | 0.3 | 1.5 | $10^{-9}$ |

Example 6

A luminous vessel for a high pressure discharge lamp of FIG. 7 was produced, according to the procedure shown in FIGS. 16 and 17.

Specifically, a molybdenum plate was deep drawn to produce a cylindrical metal piece 7 having a thickness of 0.2 mm. Alternatively, molybdenum powder was extruded to a shape of a tube and sintered to prepare a cylindrical metal piece 7 having a thickness of 0.2 mm. Further, a sealing member 6 made of a high purity alumina sintered body was prepared. A cylindrical metal piece 7 was fixed to the outside of the member 6, and a molded body 9A of alumina powder was fixed to the outside of the metal piece. The molded body 9A was a molded body 9 for a tube shaped luminous vessel (molded at a pressure of 1500 kg/$cm^2$) made of a high purity alumina having an inner diameter of 2.1 mm, an outer diameter of 4 mm and a length of 20 mm. The molded body was molded with a dry bag molding machine. The assembly was sintered in hydrogen atmosphere at 1800° C. to obtain a luminous vessel shown in FIG. 16(*b*).

On the other hand, produced was a joined body 3C of the electrode and current through conductor 2 and the sealing member 11C of molybdenum cermet was produced according to the same procedure as the example 1. The ring-shaped protrusion 4 and plate shaped metal piece 7 were welded using laser. The resulting luminous container with one end welded was transferred into a glove box. In atmosphere of high purity argon gas, a predetermined amount of halogenized metal of scandium-sodium series and mercury were supplied through a hole formed in the sealing member attached to the other end of the luminous vessel with no joined body welded. The joined body 3C was further inserted into the hole to weld the ring-shaped protrusion 4 and plate shaped metal piece 7 by laser. The luminous vessel for a high pressure discharge lamp shown in FIG. 16(*c*) was produced according to the procedure. A lead wire was welded to the luminous vessel for power supply, and the vessel was inserted into a glass outer vessel to produce a lamp. Current was flown in the lamp using a predetermined stabilizing power source so that the lamp can be successfully turned on as a metal halide high pressure discharge lamp.

The invention claimed is:

1. A luminous vessel comprising:

a luminous container comprising a brittle material;

a sintered body of a molded body comprising at least metal powder, said sintered body having a through hole formed therein;

a solid electrode comprising a metal or a cermet, said electrode being inserted through said through hole, said sintered body being fixed to the outside of said electrode;

a metal plate comprising a clamped part and a non-clamped part, said metal plate having inner and outer surfaces and said non-clamped part being fixed to said sintered body in an air-tight manner; and an inner member comprising a brittle material and fixed to said inner surface of said clamped part;

wherein said luminous vessel is fixed to said outer surface of said clamped part, or said luminous vessel further comprises an outer member comprising a brittle material and fixed to said outer surface of said clamped part, said outer member being fixed to said luminous vessel.

2. The luminous vessel of claim 1, wherein said solid electrode extends completely through the entire thickness of said sintered body, wherein said sintered body adheres and bonds to said outer surface of said solid electrode by a compressive force that is applied on said outer surface of said solid electrode as a result of sintering shrinkage exhibited by said molded body during sintering after said solid electrode is inserted into said molded body, and wherein an inner surface of said sintered body and said outer surface of said solid electrode contact one another over the entire thickness of said sintered body to alone provide an air-tight seal.

3. The luminous vessel of claim 1, wherein said sintered body comprises a shape of a disk or a tube.

4. The luminous vessel of claim 1, wherein said solid electrode comprises a fixed part where said sintered body is fixed, said fixed part comprising a single material.

5. The luminous vessel of claim 1, wherein said sintered body functions as a fitting part for said luminous container.

6. The luminous vessel of claim 5, wherein said sintered body functions as an electrode radiator.

7. The luminous vessel of claim 5, wherein said sintered body functions as a sleeve for adjusting the diameter of said solid electrode.

8. The luminous vessel of claim 5, wherein said sintered body functions as an end part for the welding with a current lead wire.

9. The luminous vessel of claim 1, wherein said current solid electrode comprises a wire of a metal having a high melting point or a cermet comprising a metal having a high melting point.

10. The luminous vessel of claim 9, wherein said metal having a high melting point comprises one or more metal, or an alloy thereof, selected from the group consisting of tungsten, molybdenum, tantalum and iridium.

11. The luminous vessel of claim 1, wherein said sintered body comprises a metal having a high melting point or a cermet comprising a metal having a high melting point.

12. The luminous vessel of claim 1, wherein said solid electrode has an outer diameter of 5 mm or smaller.

13. The luminous vessel of claim 1, wherein said sintered body has an outer diameter of 10 mm or smaller and larger than the outer diameter of said solid electrode by 0.1 mm or larger.

14. The luminous vessel of claim 1, wherein said sintered body has a thickness of 0.5 mm or larger and 20 mm or smaller.

15. The luminous vessel of claim 1, wherein said sintered body comprises a ring-shaped protrusion in the outer part, and wherein said protrusion has a thickness of 0.1 to 1 mm and a height of 1 mm to 5 mm.

16. The luminous vessel of claim 4, wherein said solid electrode comprises a single material.

17. A high pressure discharge lamp comprising the luminous vessel of claim 1.

18. The luminous vessel of claim 1, wherein the said solid electrode extends longitudinally out of opposite ends of said sintered body.

19. The luminous vessel of claim 1, wherein said solid electrode comprises a plurality of elongate products connected in the longitudinal direction at a connecting part, and wherein said elongate products are fixed at least at said connecting part within said sintered body.

* * * * *

UNITED STATES PATENT AND TRADEMARK OFFICE

CERTIFICATE OF CORRECTION

PATENT NO. : 7,843,137 B2
APPLICATION NO. : 11/392106
DATED : November 30, 2010
INVENTOR(S) : Keiichiro Watanabe, Takashi Ota and Norikazu Niimi It is certified that error appears in the above-identified patent and that said Letters Patent is hereby corrected as shown below:

Column 20

*Line 16*: please delete "current" after "wherein said"

*Line 44*: please delete "the" after "wherein"

Signed and Sealed this
First Day of February, 2011

David J. Kappos

David J. Kappos
*Director of the United States Patent and Trademark Office*